US008777787B2

(12) United States Patent
Raynak et al.

(10) Patent No.: US 8,777,787 B2
(45) Date of Patent: Jul. 15, 2014

(54) SPORT BALL

(75) Inventors: Geoffrey C. Raynak, Portland, OR (US); Zvi Rapaport, Portland, OR (US); Vincent F. White, Beaverton, OR (US); Mark McNamee, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/451,206

(22) Filed: Apr. 19, 2012

(65) Prior Publication Data

US 2012/0202627 A1 Aug. 9, 2012

Related U.S. Application Data

(62) Division of application No. 12/147,874, filed on Jun. 27, 2008, now Pat. No. 8,182,379.

(51) Int. Cl.
*A63B 41/10* (2006.01)

(52) U.S. Cl.
USPC ..... 473/604; 473/605

(58) Field of Classification Search
USPC ..... 473/603–605, 599
See application file for complete search history.

(56) References Cited

U.S. PATENT DOCUMENTS

| | | | | |
|---|---|---|---|---|
| 414,748 | A | | 11/1889 | Bentley |
| 1,187,029 | A | | 6/1916 | Beebout |
| 1,517,859 | A | | 12/1924 | O'Shea |
| 1,575,281 | A | | 3/1926 | Rosenberg |
| 1,917,535 | A | | 7/1933 | Maynard |
| 1,923,236 | A | | 8/1933 | Sonnett |
| 1,932,226 | A | | 10/1933 | Pierce |
| 1,967,908 | A | | 7/1934 | Sneary |
| 2,012,376 | A | | 8/1935 | Caro |
| 2,018,559 | A | | 10/1935 | Horner |
| 2,080,894 | A | | 5/1937 | Levinson |
| 2,126,220 | A | | 8/1938 | Scudder |
| 2,149,465 | A | * | 3/1939 | Riddell ..... 473/604 |
| 2,214,179 | A | | 9/1940 | Reach |
| 2,244,503 | A | | 6/1941 | Riddell |
| 2,280,314 | A | * | 4/1942 | Scudder ..... 473/604 |
| 2,300,441 | A | | 11/1942 | Voit et al. |
| 2,325,073 | A | | 7/1943 | Reach |
| 2,344,638 | A | | 3/1944 | Reeder |

(Continued)

FOREIGN PATENT DOCUMENTS

| | | |
|---|---|---|
| BE | 535426 | 2/1955 |
| DE | 1169820 | 5/1964 |

(Continued)

OTHER PUBLICATIONS

International Search Report and Written Opinion for PCT/US2009/045393, mailed Oct. 6, 2009.

(Continued)

*Primary Examiner* — Steven Wong
(74) *Attorney, Agent, or Firm* — Plumsea Law Group, LLC

(57) ABSTRACT

A sport ball may include a casing, an intermediate layer, and a bladder. In manufacturing the sport ball, a panel element of the casing and the bladder may be located in a mold, and a polymer foam material of the intermediate layer may be injected into an area between the bladder and the panel element. In addition, edges of panel element may be heatbonded to each other to join the panel elements and form seams of the casing.

20 Claims, 28 Drawing Sheets

(56) References Cited

U.S. PATENT DOCUMENTS

| | | | | | |
|---|---|---|---|---|---|
| 2,623,747 | A | * | 12/1952 | Crowley | 473/605 |
| 2,653,818 | A | | 9/1953 | Tebbetts, Jr. et al. | |
| 2,945,693 | A | | 7/1960 | Way | |
| 3,508,750 | A | * | 4/1970 | Henderson | 473/605 |
| 3,512,777 | A | | 5/1970 | Henderson | |
| 4,154,789 | A | | 5/1979 | Delacoste | |
| 4,219,945 | A | | 9/1980 | Rudy | |
| 4,258,917 | A | | 3/1981 | Murphy | |
| 4,310,978 | A | | 1/1982 | Stern | |
| 4,436,276 | A | | 3/1984 | Donahue | |
| 4,462,590 | A | | 7/1984 | Mitchell | |
| 4,513,058 | A | | 4/1985 | Martin | |
| 4,610,071 | A | | 9/1986 | Miller | |
| 4,660,831 | A | * | 4/1987 | Kralik | 473/603 |
| 4,936,029 | A | | 6/1990 | Rudy | |
| 5,042,176 | A | | 8/1991 | Rudy | |
| D322,105 | S | | 12/1991 | Ma | |
| 5,069,935 | A | | 12/1991 | Walters | |
| 5,096,756 | A | | 3/1992 | Walters | |
| 5,123,659 | A | | 6/1992 | Williams | |
| 5,181,717 | A | | 1/1993 | Donntag et al. | |
| 5,250,070 | A | | 10/1993 | Parodi | |
| 5,306,001 | A | | 4/1994 | Shishido et al. | |
| 5,494,625 | A | | 2/1996 | Hu | |
| 5,503,699 | A | | 4/1996 | Ratner et al. | |
| 5,542,662 | A | | 8/1996 | Kouzai et al. | |
| 5,580,049 | A | * | 12/1996 | Brantley | 473/599 |
| 5,603,497 | A | | 2/1997 | Louez | |
| 5,681,233 | A | * | 10/1997 | Guenther et al. | 473/605 |
| 5,713,141 | A | | 2/1998 | Mitchell et al. | |
| 5,752,890 | A | | 5/1998 | Shishido et al. | |
| 5,772,545 | A | | 6/1998 | Ou | |
| 5,888,157 | A | | 3/1999 | Guenther et al. | |
| 5,931,752 | A | * | 8/1999 | Guenther et al. | 473/597 |
| 5,952,065 | A | | 9/1999 | Mitchell et al. | |
| 6,012,997 | A | | 1/2000 | Mason | |
| 6,013,340 | A | | 1/2000 | Bonk et al. | |
| 6,024,661 | A | * | 2/2000 | Guenther et al. | 473/605 |
| 6,082,025 | A | | 7/2000 | Bonk et al. | |
| 6,127,026 | A | | 10/2000 | Bonk et al. | |
| 6,142,897 | A | | 11/2000 | Lees | |
| 6,203,868 | B1 | | 3/2001 | Bonk et al. | |
| 6,261,400 | B1 | | 7/2001 | Kennedy, III | |
| 6,302,815 | B1 | | 10/2001 | Shishido et al. | |
| 6,321,465 | B1 | | 11/2001 | Bonk et al. | |
| 6,406,389 | B1 | | 6/2002 | Feeney et al. | |
| 6,422,961 | B1 | | 7/2002 | Feeney | |
| 6,461,461 | B2 | | 10/2002 | Kennedy, III | |
| 6,503,162 | B1 | * | 1/2003 | Shishido et al. | 473/605 |
| 6,629,902 | B2 | | 10/2003 | Murphy et al. | |
| 6,645,099 | B2 | | 11/2003 | Gaff et al. | |
| 6,685,585 | B2 | | 2/2004 | Shishido et al. | |
| 6,726,582 | B1 | | 4/2004 | Kuo et al. | |
| 6,971,965 | B1 | | 12/2005 | Shishido | |
| 6,991,569 | B2 | | 1/2006 | Dobrounig | |
| 7,005,025 | B2 | | 2/2006 | Summers | |
| 7,029,407 | B2 | | 4/2006 | Lee et al. | |
| 7,066,853 | B2 | | 6/2006 | Chang | |
| 7,137,915 | B2 | * | 11/2006 | Lin | 473/605 |
| 2,073,766 | A1 | | 10/2008 | Suzuki | |
| 7,749,116 | B2 | | 7/2010 | Tang et al. | |
| 7,753,813 | B2 | | 7/2010 | Taniguchi et al. | |
| 7,854,815 | B2 | | 12/2010 | Taniguchi et al. | |
| 8,182,379 | B2 | | 5/2012 | Rapaport et al. | |
| 2001/0002378 | A1 | | 5/2001 | Calandro | |
| 2002/0086749 | A1 | | 7/2002 | Ou | |
| 2002/0098928 | A1 | * | 7/2002 | Ou | 473/604 |
| 2003/0078119 | A1 | * | 4/2003 | Shishido et al. | 473/605 |
| 2003/0176246 | A1 | * | 9/2003 | Gaff et al. | 473/605 |
| 2003/0203780 | A1 | * | 10/2003 | Guenther et al. | 473/604 |
| 2004/0077288 | A1 | * | 4/2004 | Krysiak et al. | 446/491 |
| 2004/0144477 | A1 | | 7/2004 | Taniguchi et al. | |
| 2004/0229722 | A1 | | 11/2004 | Liu | |
| 2005/0081982 | A1 | | 4/2005 | Chen | |
| 2005/0153803 | A1 | | 7/2005 | Swiszcz et al. | |
| 2005/0229985 | A1 | | 10/2005 | Saxenfelt | |
| 2006/0063622 | A1 | | 3/2006 | Nurnberg et al. | |
| 2006/0148601 | A1 | * | 7/2006 | Ou | 473/601 |
| 2006/0199685 | A1 | | 9/2006 | Ou | |
| 2006/0205544 | A1 | | 9/2006 | Wayner et al. | |
| 2006/0205547 | A1 | | 9/2006 | O'Neill et al. | |
| 2006/0229149 | A1 | | 10/2006 | Goedoen | |
| 2006/0229150 | A1 | * | 10/2006 | Ou | 473/604 |
| 2006/0293132 | A1 | * | 12/2006 | Laliberty et al. | 473/603 |
| 2007/0032320 | A1 | * | 2/2007 | Laliberty et al. | 473/604 |
| 2007/0049434 | A1 | | 3/2007 | Maziarz et al. | |
| 2007/0072712 | A1 | | 3/2007 | Chernick et al. | |
| 2007/0129188 | A1 | * | 6/2007 | Maziarz et al. | 473/603 |
| 2007/0225094 | A1 | * | 9/2007 | Nix | 473/605 |
| 2007/0246296 | A1 | | 10/2007 | Xiao et al. | |
| 2008/0139349 | A1 | * | 6/2008 | Ou | 473/604 |
| 2008/0176685 | A1 | * | 7/2008 | Madore et al. | 473/599 |
| 2008/0287230 | A1 | | 11/2008 | Guenther et al. | |
| 2009/0011878 | A1 | * | 1/2009 | Ou | 473/605 |
| 2009/0209374 | A1 | * | 8/2009 | Ou | 473/605 |
| 2009/0325740 | A1 | * | 12/2009 | Krysiak | 473/596 |
| 2009/0325744 | A1 | | 12/2009 | Raynak et al. | |
| 2010/0240479 | A1 | | 9/2010 | Raynak | |
| 2011/0152018 | A1 | | 6/2011 | Walling et al. | |
| 2011/0250997 | A1 | | 10/2011 | Walling et al. | |
| 2012/0202627 | A1 | | 8/2012 | Raynak et al. | |
| 2012/0258824 | A1 | | 10/2012 | Berggren et al. | |
| 2013/0005521 | A1 | | 1/2013 | White et al. | |

FOREIGN PATENT DOCUMENTS

| | | | |
|---|---|---|---|
| DE | 102004056951 | | 6/2006 |
| EP | 0598542 | | 5/1994 |
| EP | 0941749 | | 9/1999 |
| EP | 1 080 745 | A1 | 3/2001 |
| FR | 2572674 | | 5/1986 |
| JP | 10337341 | | 12/1998 |
| WO | 2004/056424 | A1 | 7/2004 |
| WO | 2004056424 | | 7/2004 |
| WO | 2007/146095 | A1 | 12/2007 |
| WO | 2009/158103 | A1 | 12/2009 |
| WO | WO2009158103 | A1 | 12/2009 |
| WO | WO2011028640 | A1 | 3/2011 |
| WO | 2013/003221 | A1 | 1/2013 |
| WO | WO2013003221 | A1 | 1/2013 |
| WO | 2013148947 | | 10/2013 |

OTHER PUBLICATIONS

U.S. Appl. No. 13/170,912, filed Jun. 28, 2011.

International Search Report and Written Opinion in PCT Application No. PCT/US2012/043700, mailed on Oct. 19, 2012.

Office Action mailed Mar. 10, 2010 in U.S. Appl. No. 12/147,874.

Amendment filed Jun. 4, 2010 in response to Office Action mailed Mar. 10, 2010 in U.S. Appl. No. 12/147,874.

Office Action mailed Aug. 19, 2010 in U.S. Appl. No. 12/147,874.

Amendment filed Nov. 19, 2010 in response to Office Action mailed Aug. 19, 2010 in U.S. Appl. No. 12/147,874.

Final Office Action mailed Jan. 25, 2011 in U.S. Appl. No. 12/147,874.

Amendment filed Mar. 22, 2011 in response to Final Office Action mailed Jan. 25, 2011 in U.S. Appl. No. 12/147,874.

Amendment filed Apr. 19, 2011 with RCE in response to Office Action mailed Jan. 25, 2011 in U.S. Appl. No. 12/147,874.

Office Action mailed Sep. 6, 2011 in U.S. Appl. No. 12/147,874.

Amendment filed Dec. 1, 2011 in response to Office Action mailed Sep. 6, 2011 in U.S. Appl. No. 12/147,874.

Notice of Allowance mailed Jan. 23, 2012 in U.S. Appl. No. 12/147,874.

Claims filed in European Application No. 12748284.2 on Jan. 21, 2014.

International Search Report and Written Opinion dated Dec. 13, 2013 cited in PCT/US2013/034276.

Office Action mailed Aug. 26, 2013 in U.S. Appl. No. 13/170,912.

Amendment filed Nov. 26, 2013 in response to Office Action mailed Aug. 26, 2013 in U.S. Appl. No. 13/170,912.

(56) References Cited

OTHER PUBLICATIONS

Notice of Allowance/Allowability issued Dec. 16, 2013 in U.S. Appl. No. 13/170,912.

Restriction dated Nov. 27, 2013 in U.S. Appl. No. 13/434,897.

Response to Restriction filed Dec. 27, 2013 in U.S. Appl. No. 13/434,897.

* cited by examiner

SPORT BALL

CROSS-REFERENCE TO RELATED APPLICATION

This application is a divisional of prior pending nonprovisional application Ser. No. 12/147,874, filed 27 Jun. 2008, the entire disclosure of which is hereby incorporated by reference.

BACKGROUND

A variety of inflatable sport balls, such as a soccer ball, conventionally exhibit a layered structure that includes a casing, an intermediate layer, and an inflatable bladder. The casing forms an exterior layer of the sport ball and is generally formed from a plurality of durable, wear-resistant panels joined together along abutting edges (e.g., with stitching or adhesives). Although panel configurations may vary significantly, the casing of a traditional soccer ball includes thirty-two panels, twelve of which have a pentagonal shape and twenty of which have a hexagonal shape. The intermediate layer forms a middle layer of the sport ball and is positioned between the bladder and the casing. The bladder, which has an inflatable configuration, is located within the intermediate layer to provide an inner layer of the sport ball. In order to facilitate inflation (i.e., with air), the bladder generally includes a valved opening that extends through each of the intermediate layer and casing, thereby being accessible from an exterior of the sport ball.

The intermediate layer of a conventional sport ball may have a variety of configurations. As an example, a conventional intermediate layer may be formed from multiple material layers that include (a) a compressible foam layer located adjacent to the casing to impart a softened feel to the sport ball, (b) a rubber layer that imparts energy return, (c) a textile layer with a limited degree of stretch in order to restrict expansion of the bladder, and (d) multiple adhesive layers that extend between and join the foam, rubber, and textile layers. Although the intermediate layers of some sport balls incorporate each of these layers, one or more of these layers may be absent. Moreover, the configuration of the individual layers may vary significantly. For example, the textile layer may be formed from (a) a plurality of generally flat or planar textile elements that are stitched together, (b) a thread, yarn, or filament that is repeatedly wound around the bladder in various directions to form a mesh, or (c) a plurality of generally flat or planar textile strips that are impregnated with latex and placed in an overlapping configuration around the bladder. The various layers of the intermediate layer may also be bonded, joined, or otherwise incorporated into the casing as a backing material.

SUMMARY

A sport ball may include a casing, an intermediate layer, and a bladder. The casing forms at least a portion of an exterior surface of the ball. The intermediate layer is at least partially formed from a foam material located adjacent to the casing and within the casing. The bladder has an inflatable configuration and is located adjacent to the intermediate layer and within the intermediate layer. The foam material of the intermediate layer may be bonded to each of the casing and the bladder.

In manufacturing a sport ball, a bladder may be located in a mold and a polymer foam material may be injected into the mold and onto a surface of the bladder. In some configurations, panel elements may also be located within the mold, and the polymer foam material may be injected into an area between the bladder and the panel elements. In addition, edges of the panel elements may be heatbonded to each other to join the panel elements and form a casing of the sport ball.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various sport ball configurations and methods of manufacturing the sport balls. Although the sport ball configurations are discussed and depicted in relation to a soccer ball, concepts associated with the configurations and methods may be applied to various types of inflatable sport balls. In addition to soccer balls, therefore, concepts discussed herein may be incorporated into basketballs, footballs (for either American football or rugby), and volleyballs, for example. A variety of non-inflatable sport balls, such as baseballs, softballs, and golf balls, may also incorporate concepts discussed herein.

Sport Ball Structure

Figure 1:
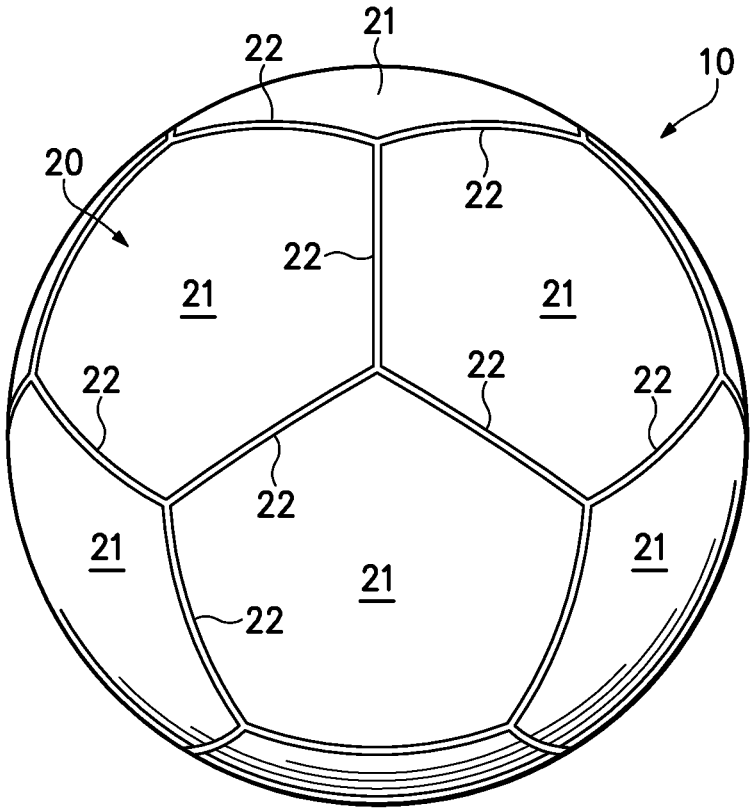
FIG. 1 is a perspective view of a sport ball.
Figure 2:
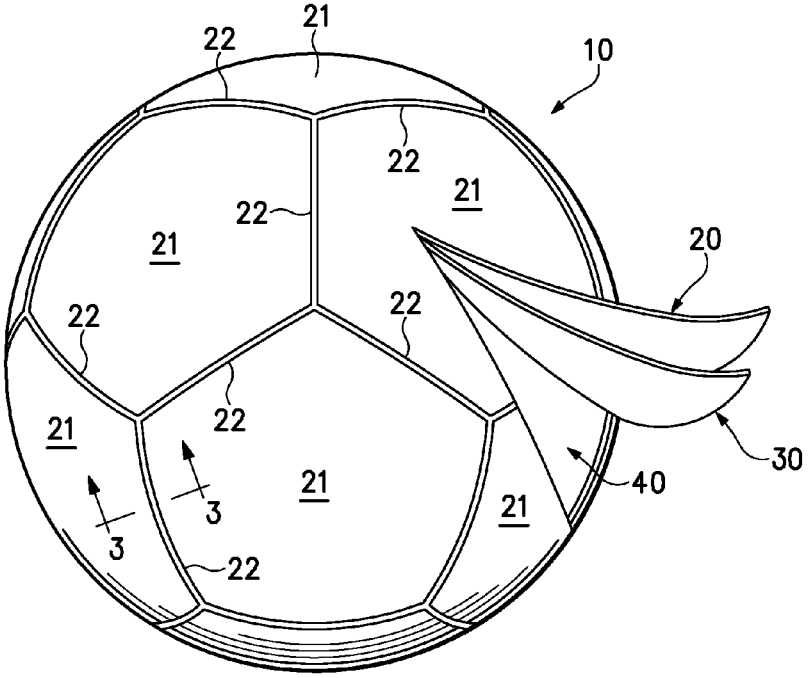
FIG. 2 is another perspective view of the sport ball.
Figure 3:
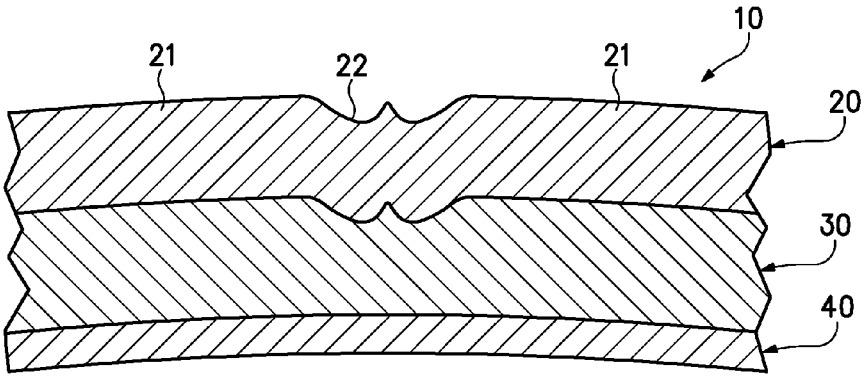
FIG. 3 is a partial cross-sectional view of the sport ball, as defined by section line 3-3 in FIG. 2.

A sport ball 10 with the configuration of a soccer ball is depicted in FIGS. 1 and 2. Ball 10 has a layered structure that includes a casing 20, an intermediate layer 30, and an inflatable or inflated bladder 40, each of which are depicted in FIGS. 2 and 3. Casing 20 forms an exterior of ball 10 and is generally formed from various panels 21 that are joined along abutting sides or edges to form a plurality of seams 22. Each of panels 21 are depicted as having the shapes of equilateral pentagons. In further configurations of ball 10, however, panels 21 may be formed from a combination of pentagonal and hexagonal shapes, panels 21 may have non-equilateral shapes, panels 21 may have concave or convex edges, and selected panels 21 may be formed integral with adjacent panels 21 to form bridged panels that reduce the number of seams 22, for example. Panels 21 may also have a variety of other shapes (e.g., triangular, square, rectangular, hexagonal, trapezoidal, round, oval) that combine in a tessellation-type manner to form casing 20, and panels 21 may also exhibit non-regular or non-geometrical shapes. In other configurations, casing 20 may have a seamless structure (i.e., a configuration where seams 22 are absent).

Figure 4A:
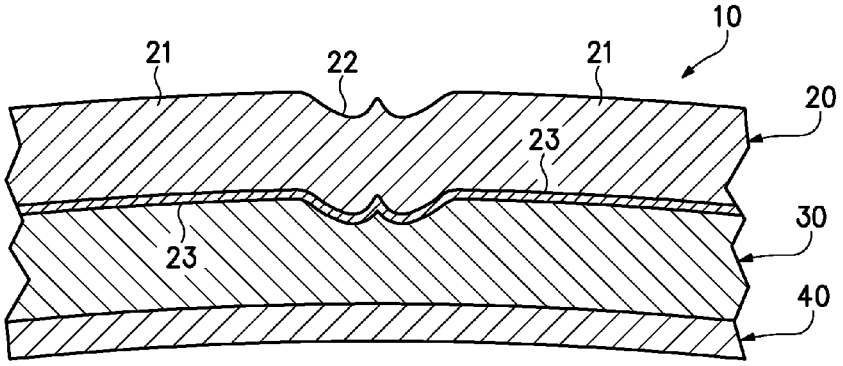
FIGS. 4A-4F are partial cross-sectional views corresponding with FIG. 3 and depicting further configurations of the sport ball.

The materials selected for casing 20 may be leather, polyurethane, polyvinyl chloride, various other thermoplastic or thermoset materials, or other suitable materials, whether synthetic or natural, that are generally durable and wear-resistant. In some configurations, each of panels 21 may have a layered configuration that combines two or more materials. For example, an exterior portion of each panel 21 may be formed from polyurethane, and an interior portion of each panel 21 may be formed from a textile element 23, as depicted in FIG. 4A. That is, textile element 23 may be bonded to the polyurethane and positioned adjacent to intermediate layer 30. As an alternative to textile element 23, non-textile materials or reinforcing structures may also be incorporated into casing 20. Accordingly, the configuration of casing 20 may vary significantly to include a variety of configurations and materials.

An advantage of casing 20 relates to the manner in which panels 21 are joined to form seams 22. The panels of conventional sport balls may be joined with stitching (e.g., hand or machine stitching). Although panels 21 may be joined through stitching in some configurations, a heatbonding method is utilized in ball 10 to join panels 21 and form seams 22. More particularly, panels 21 may be formed from a thermoplastic material, and edges of panels 21 may be heated and bonded to each other to form seams 22. An advantage of heatbonding when forming seams 22 relates to the overall mass of ball 10. Whereas approximately ten to fifteen percent of the mass of a conventional sport ball may be from the seams between panels, heatbonding panels 21 may reduce the mass at seams 22. By eliminating stitched seams in casing 20, the mass that would otherwise be imparted by the stitched seams may be utilized for other structural elements that enhance the performance properties (e.g., energy return, sphericity, mass distribution, durability, aerodynamics) of ball 10.

Figure 4B:
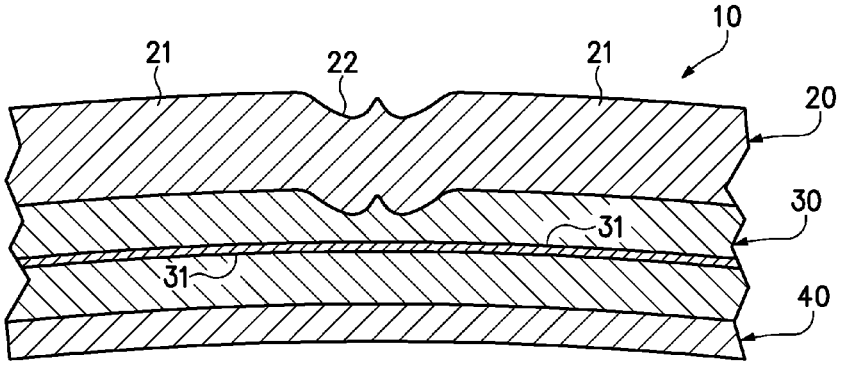
Figure 4C:
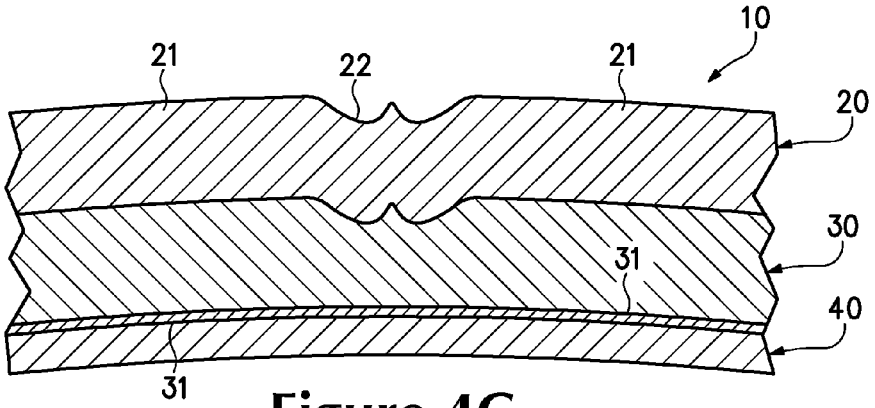
Figure 4D:
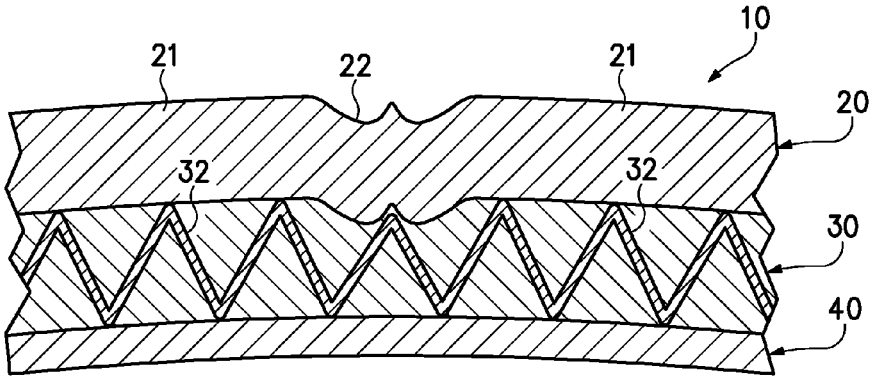
Figure 4E:
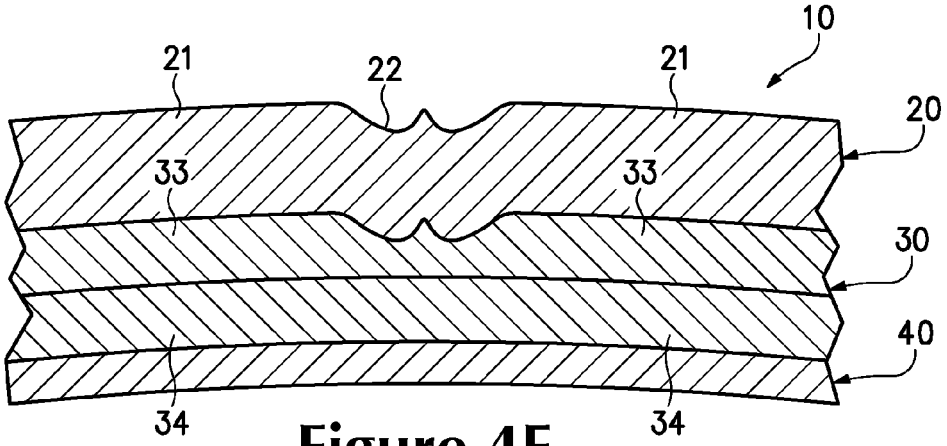

Intermediate layer 30 forms a middle layer of ball 10 that is positioned between casing 20 and bladder 40. As discussed in the Background section above, conventional intermediate layers are formed from foam, rubber, textiles, and adhesive layers. In comparison, FIGS. 2 and 3 depict intermediate layer 30 as being formed from a polymer foam material. That is, the polymer foam material extends from a surface of casing 20 to a surface of bladder 40. Although substantially all of intermediate layer 30 may be formed from the polymer foam material, some configurations of intermediate layer 30 may incorporate other elements. For example, intermediate layer 30 is depicted as incorporating a textile element 31 in FIG. 4B. Although textile element 31 may extend through a central area of intermediate layer 30, textile element 31 may also be located adjacent to bladder 40, as depicted in FIG. 4C. As further examples, intermediate layer 30 is depicted as incorporating a reinforcing structure 32 in FIG. 4D, and intermediate layer 30 is depicted as incorporating a pair of different foam layers 33 and 34 in FIG. 4E. Accordingly, although intermediate layer 30 may be entirely formed from a single polymer foam material, intermediate layer 30 may also incorporate other elements or materials in some configurations of ball 10.

An advantage of the configuration of intermediate layer 30 relates to the overall mass of intermediate layer 30. A conventional intermediate layer may be formed from multiple material layers that include (a) a compressible foam layer, (b) a rubber layer, (c) a textile layer, and (d) multiple adhesive layers that extend between and join the foam, rubber, and textile layers, as discussed in the Background section above. In some conventional sport balls, the mass of the adhesive layers may impart approximately twenty-five percent of the total mass of the sport balls. That is, the adhesive layers alone account for twenty-five percent of the total mass of the sport balls. By eliminating the adhesive layers in intermediate layer 30, the mass that would otherwise be imparted by the adhesive layers may be utilized for other structural elements that enhance the performance properties (e.g., energy return, sphericity, mass distribution, durability, aerodynamics) of ball 10.

Bladder 40 has an inflatable configuration and is located within intermediate layer 30 to provide an inner portion of ball 10. When inflated, bladder 40 exhibits a rounded or generally spherical shape. In order to facilitate inflation, bladder 40 may include a valved opening (not depicted) that extends through intermediate layer 30 and casing 20, thereby being accessible from an exterior of ball 10, or bladder 40 may have a valveless structure that is semi-permanently inflated. Bladder 40 may be formed from a rubber or carbon latex material that substantially prevents air or other fluids within bladder 40 from diffusing to the exterior of ball 10. In addition to rubber and carbon latex, a variety of other elastomeric or otherwise stretchable materials may be utilized for bladder 40.

Figure 4F:
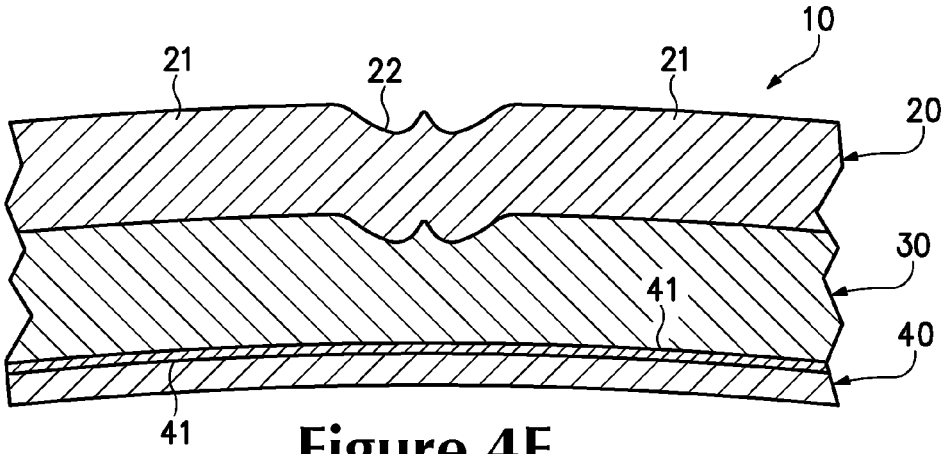
Figure 5:
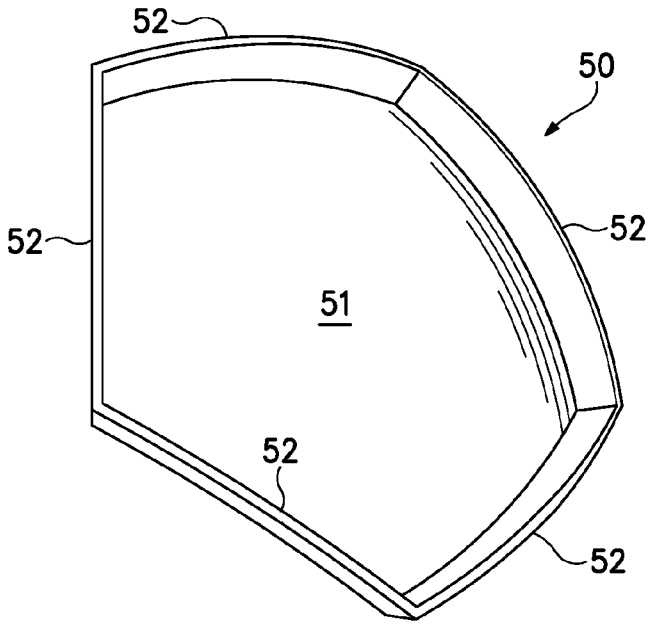
FIG. 5 is a perspective view of a blank for forming a panel of the sport ball.
Figure 6:
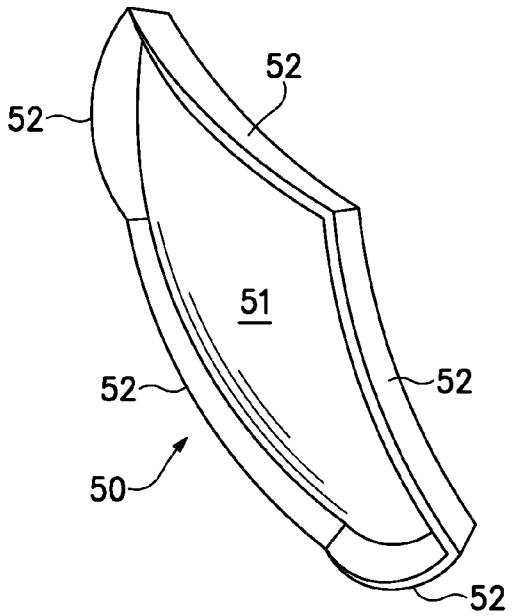
FIG. 6 is another perspective view of the blank.
Figure 7:
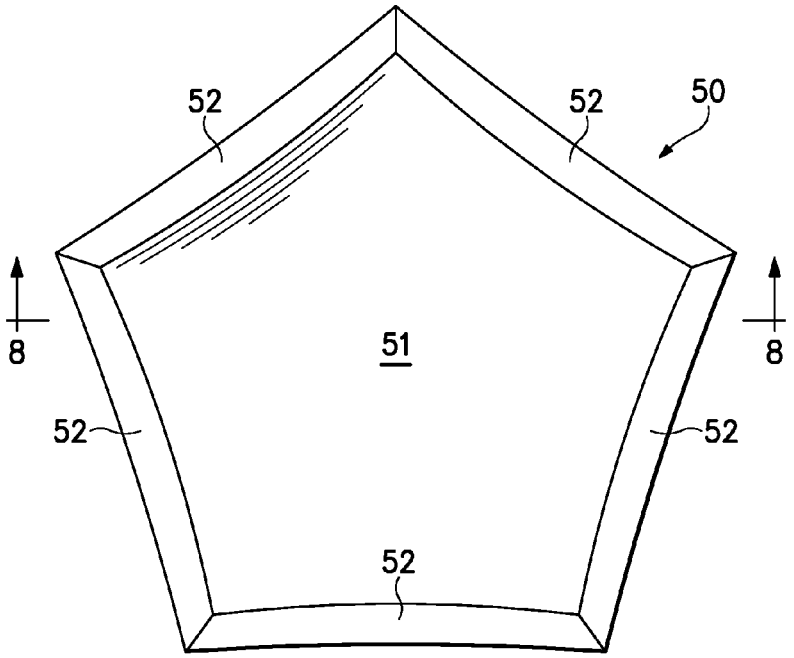
FIG. 7 is a plan view of the blank.
Figure 8:
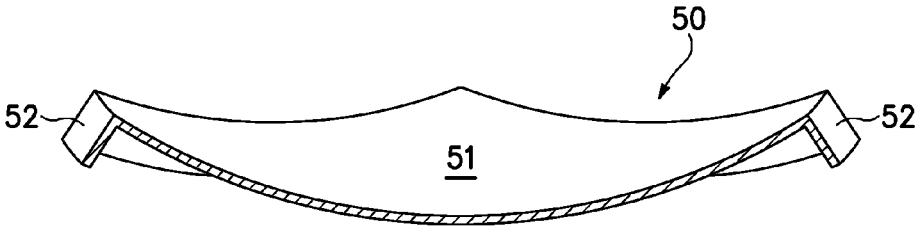
FIG. 8 is a cross-sectional view of the blank, as defined by section line 8-8 in FIG. 7.

Inflating bladder 40 induces ball 10 to take on a substantially spherical shape. More particularly, fluid pressure from air within bladder 40 causes bladder 40 to expand and place an outward force upon intermediate layer 30. In turn, intermediate layer 30 places an outward force upon casing 20. In order to limit the expansion of bladder 40 and also limit tension in casing 20, intermediate layer 30 may have a limited degree of stretch. That is, intermediate layer 30 may be formed from a foam material that has a limited degree of stretch. Alternately, textile elements 23 and 31, reinforcing structure 32, or one or both of foam layers 33 and 34 may exhibit a limited degree of stretch. In any of these configurations, the stretch characteristics of intermediate layer 30 may prevent the expansion of bladder 40 from inducing significant tension in casing 20. Accordingly, intermediate layer 30 may restrain the expansion of bladder 40, while permitting outward forces to induce a substantially spherical shape in casing 20, thereby imparting a substantially spherical shape to ball 10. In some configurations, however, bladder 40 may incorporate a tensile element 41 that restrains the overall expansion of bladder 40 and limits the tension in casing 20, as depicted in FIG. 4F.

Construction Method

A variety of construction methods may be utilized for ball 10. As an example of a suitable construction method, a polymer foam material is injected into a space between a panel blank 50 and bladder 40. Referring to FIGS. 5-8, panel blank 50 is depicted as including a panel area 51 and a flange area 52. Panel area 51 has a pentagonal configuration with a curvature that corresponds with a curvature in casing 20. Given this configuration, panel area 51 becomes one of panels 21 following the construction method and the formation of seams 22. Panel 51 is, therefore, a casing element that becomes a portion of casing 20 following the construction method. Flange area 52 extends around and outward from panel area 51 and effectively forms a flange that is utilized in joining multiple panel areas 51 together, thereby forming seams 22. Given that panel blank 50 forms one of panels 21 and various seams 22, panel blank 50 may be formed from any of the materials discussed above for casing 20.

Figure 9:
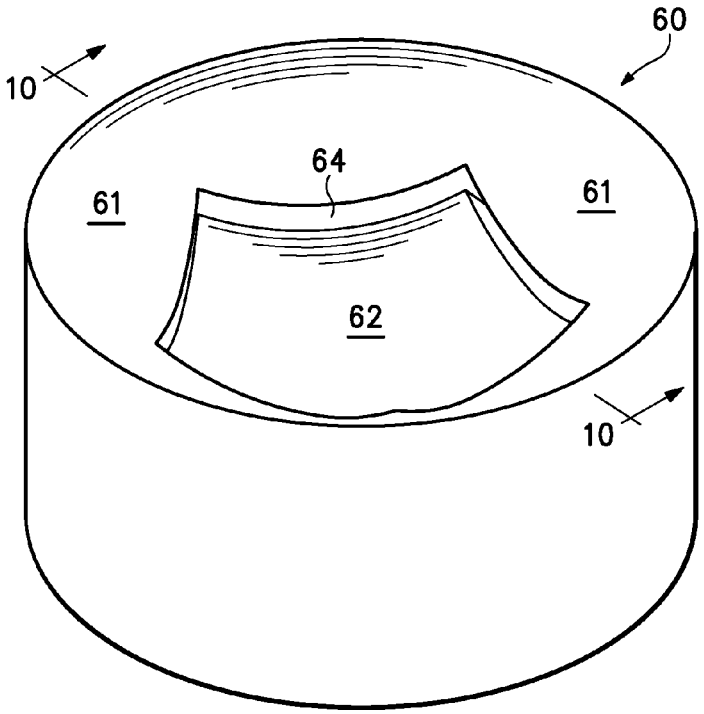
FIG. 9 is a perspective view of a first mold that may be utilized in constructing the sport ball.
Figure 10:
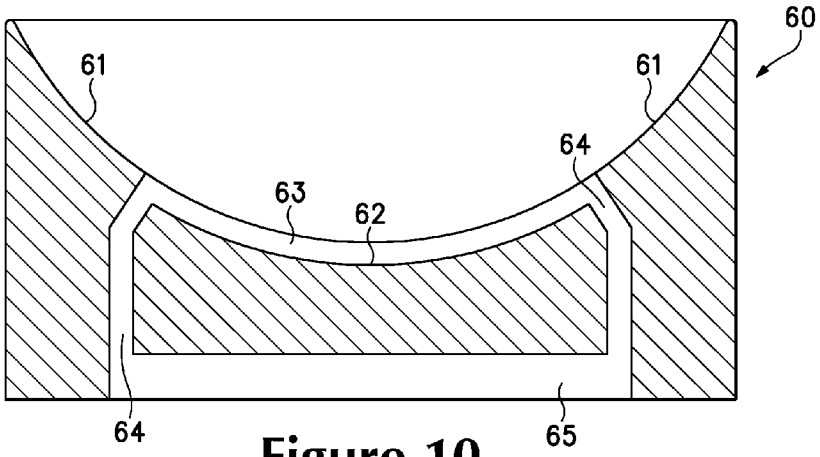
FIG. 10 is a cross-sectional view of the first mold, as defined by section line 10-10 in FIG. 9.

A mold 60 that may be utilized in constructing ball 10 is depicted in FIGS. 9 and 10. Mold 60 includes an upper portion with an outer surface 61 that surrounds a central surface 62. Outer surface 61 has an inwardly-curved or otherwise concave configuration that substantially corresponds with a curvature of an exterior of bladder 40. A middle portion of outer surface 61 defines an aperture 63 with a pentagonal shape, and central surface 62 is recessed within aperture 63. Whereas the curvature of outer surface 61 substantially corresponds with the curvature of the exterior of bladder 40, central surface 62 has an inwardly-curved or otherwise concave configuration that substantially corresponds with a curvature of an exterior of casing 20. Central surface 62 is spaced downward from outer surface 61, and a conduit 64 extends upward from a reservoir 65 to join with a periphery of central area 62.

Figure 11A:
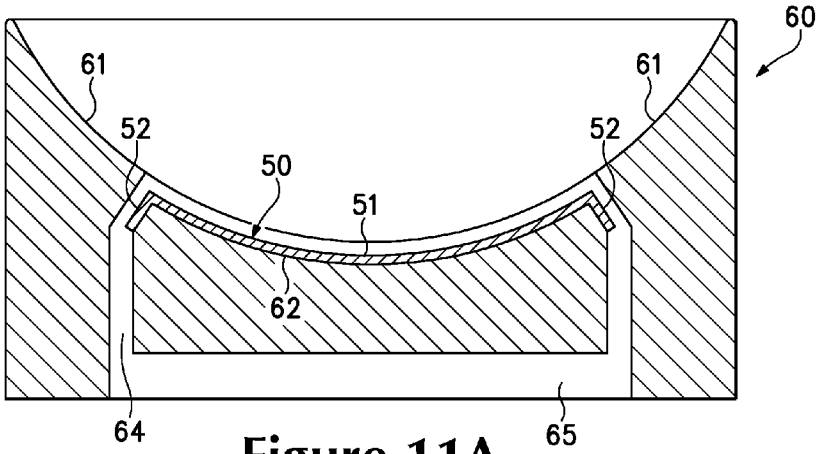
FIGS. 11A-11E are cross-sectional views corresponding with FIG. 10 and depicting a construction method for the sport ball.

The manner in which mold 60 is utilized in constructing ball 10 will now be discussed with reference to FIGS. 11A-11E. Initially, one of panel blanks 50 is located within aperture 63 and adjacent to central surface 62, as depicted in FIG. 11A. More particularly, panel area 51 is positioned to contact central surface 62 and flange area 52 is positioned to extend into conduit 64. As discussed above, panel area 51 has a curvature that corresponds with a curvature in casing 20, and central surface 62 substantially corresponds with a curvature of an exterior of casing 20. Given this configuration, panel area 51 matches and conforms with the inwardly-curved or otherwise concave configuration of central surface 62.

Figure 11B:
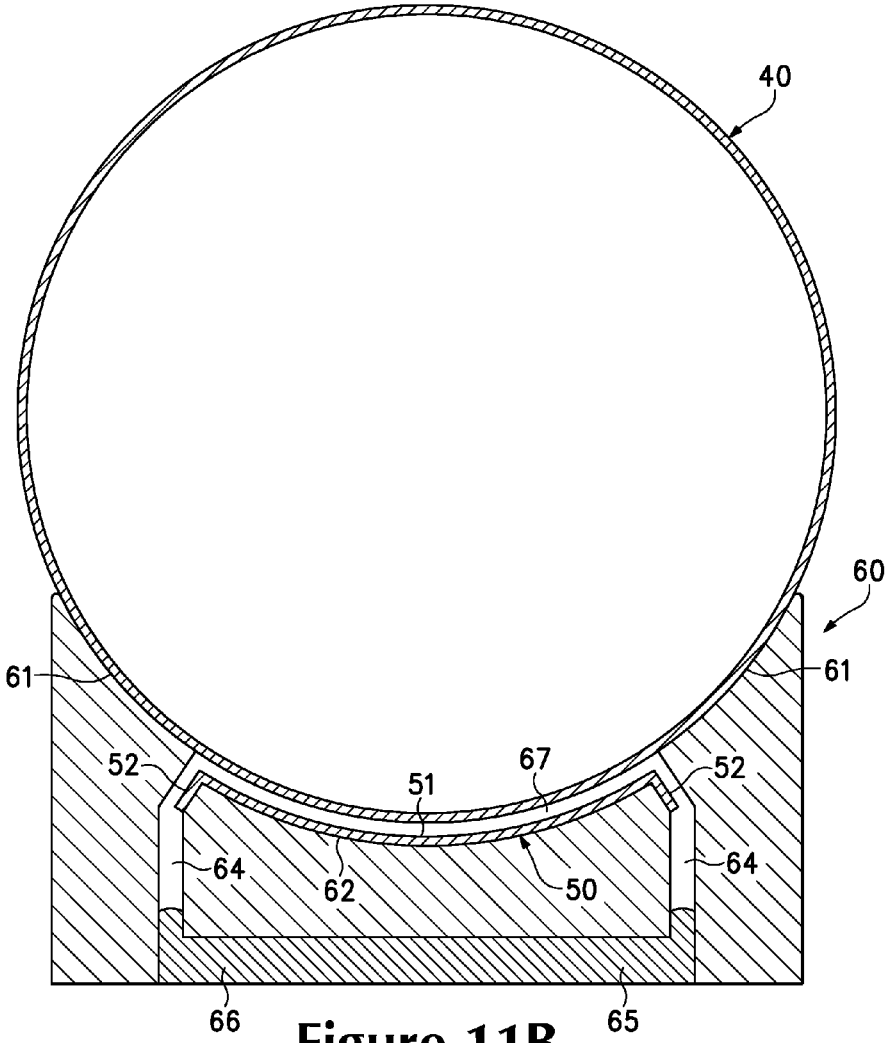

Once panel blank 50 is properly positioned, bladder 40 is inflated to a generally spherical shape having a diameter that is substantially equal to the diameter of bladder 40 within ball 10. Bladder 40 is then positioned to contact outer surface 61, as depicted in FIG. 11B. As discussed above, outer surface 61 substantially corresponds with a curvature of an exterior of bladder 40. Given this configuration, bladder 40 matches and conforms with the inwardly-curved or otherwise concave configuration of outer surface 61. Additionally, a foam material 66 in an uncured, resinous, or semi-liquid state may be located within reservoir 65.

Figure 11C:
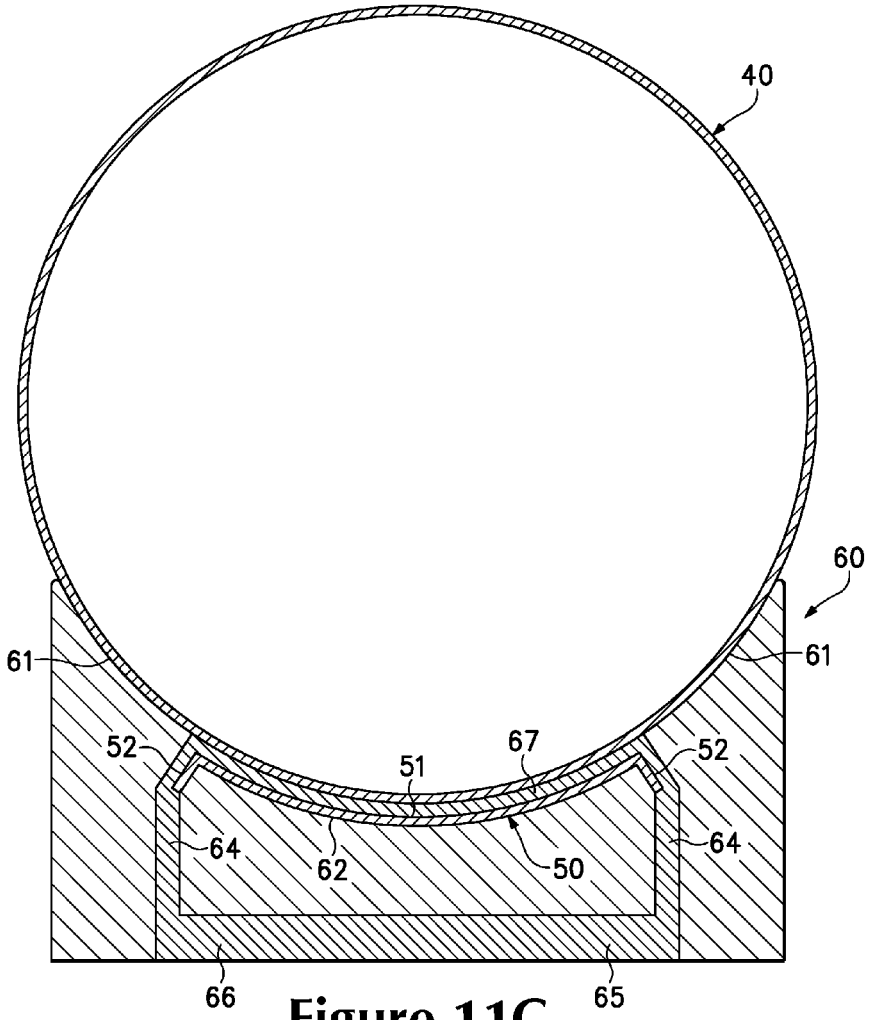

A gap 67 extends between bladder 40 and panel area 51 when (a) bladder 40 is positioned in contact with outer surface 61 and (b) panel blank 50 is positioned in contact with central surface 62, as depicted in FIG. 11B. In general, the distance between bladder 40 and panel area 51 (i.e., the distance across gap 67) corresponds with the thickness of intermediate layer 30. As discussed above, intermediate layer 30 is formed from a polymer foam material. In order to form intermediate layer 30, therefore, foam material 66 is injected or otherwise located within gap 67, as depicted in FIG. 11C. More particularly, foam material 66 passes into conduit 64 and flows upward to infiltrate the area between bladder 40 and panel area 51, thereby filling gap 67. In configurations of ball 10 where textile element 31 or reinforcing structure 32 are present, textile element 31 or reinforcing structure 32 may be located within gap 67 prior to introducing foam material 66.

Figure 11D:
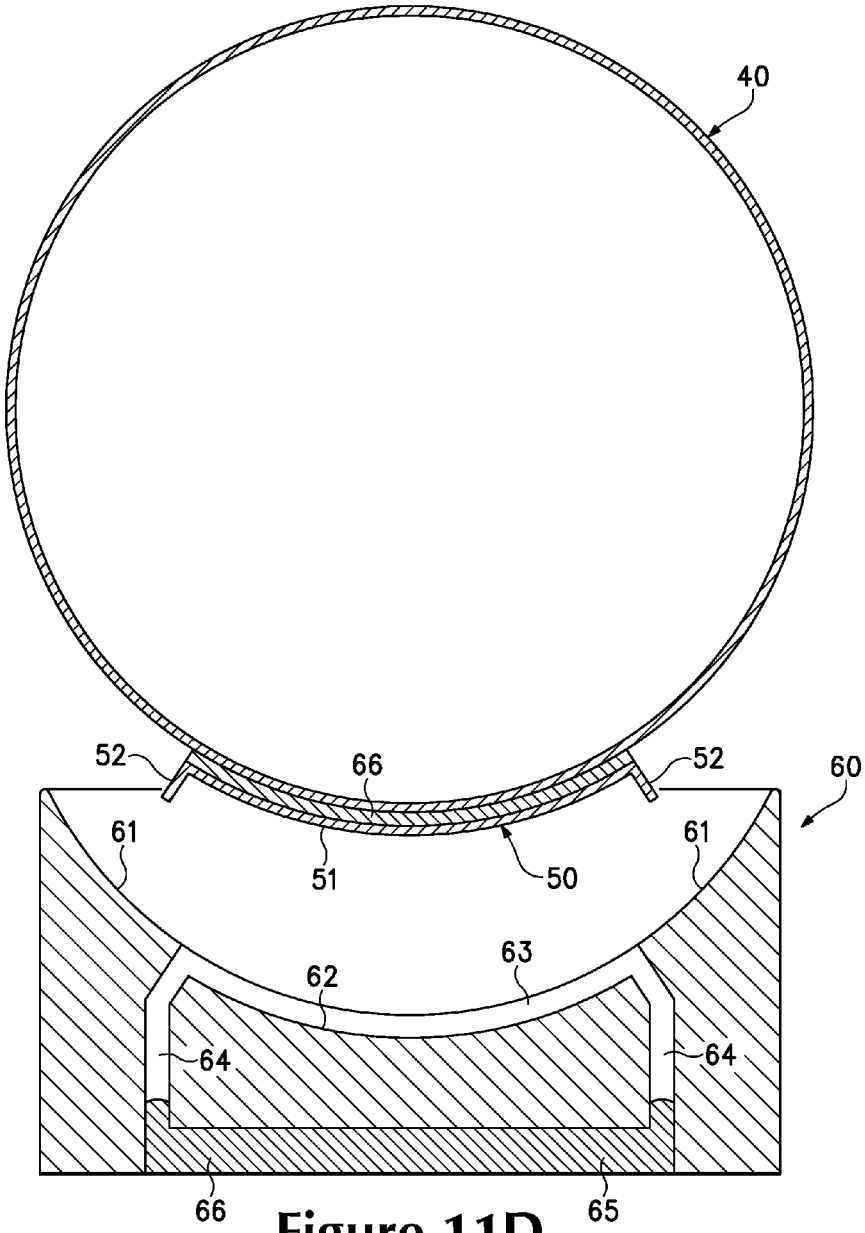

Once foam material 66 is located within gap 67, foam material 66 may begin curing and bonding with the surfaces of bladder 40 and panel area 51, thereby forming a portion of intermediate layer 30. The combination of bladder 40, panel blank 50, and foam material 66 may then be withdrawn from mold 60, as depicted in FIG. 11D. Excess foam material 66 may also be removed or cleaned from flange area 52 at this stage of the construction method.

Figure 11E:
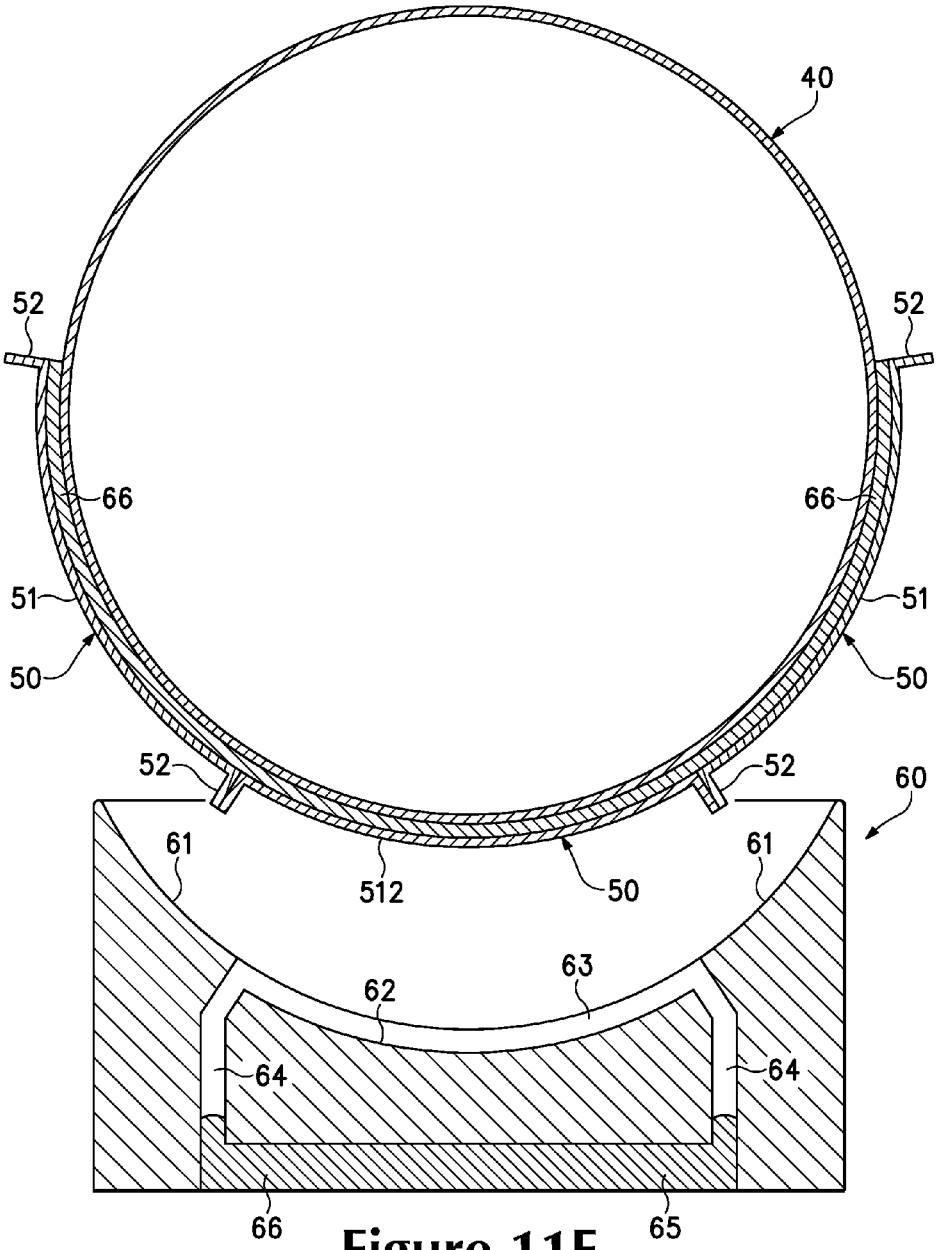
Figure 12:
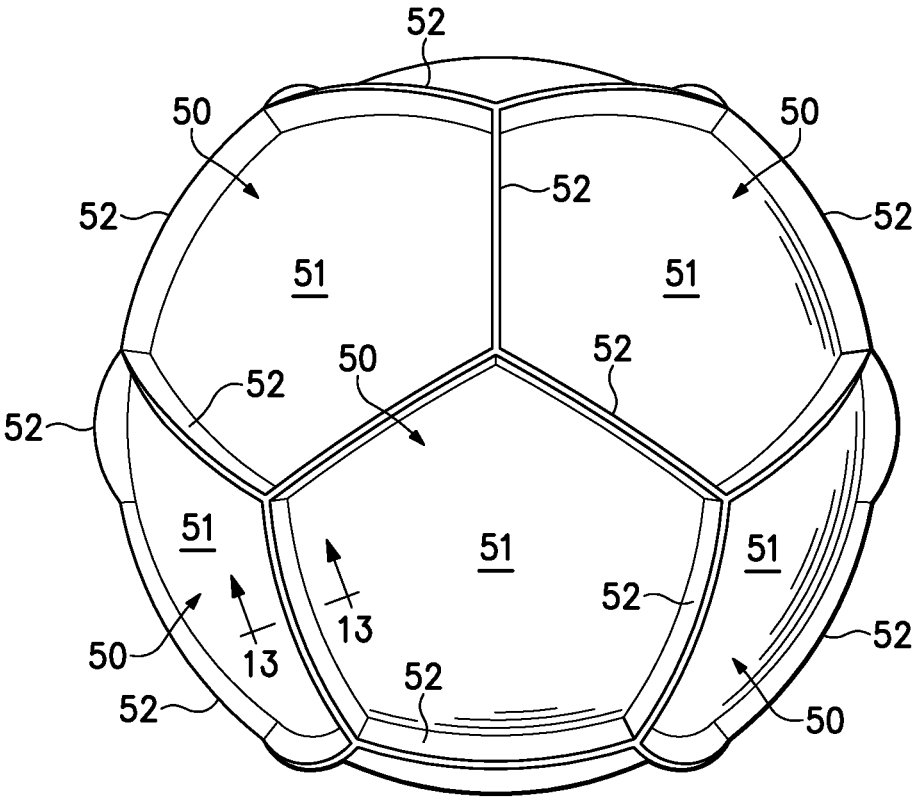
FIG. 12 is a perspective view of the sport ball following the construction method.

The general process discussed above may then be repeated to bond additional panel blanks 50 to bladder 40 with foam material 66, as depicted in FIG. 11E. That is, a substantially similar process may be utilized to form other portions of intermediate layer 30 between the additional panel blanks 50 and bladder 40. Depending upon the manner in which ball 10 is assembled, additional molds with similar structures may be utilized to form intermediate layer 30 in areas that are adjacent to previously-formed portions of intermediate layer 30. That is, mold 60 may be utilized to place the initial panel blank 50 and form an initial portion of intermediate layer 30, but molds with similar structures may be utilized to place the further panel blanks 50 and form further portions of intermediate layer 30. Once, all portions of intermediate layer 30 are formed between panel blanks 50 and bladder 40, ball 10 may exhibit the configuration depicted in FIGS. 12 and 13.

Seam Formation

Figure 13:
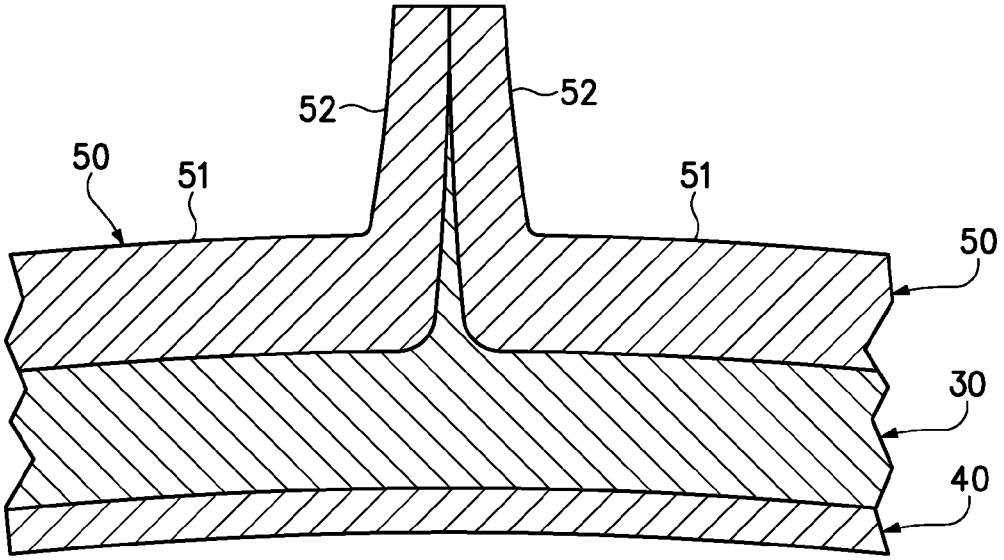
FIG. 13 is a partial cross-sectional view of the sport ball following the construction method, as defined by section line 13-13 in FIG. 12.

Following the injection of foam material 66, which becomes intermediate layer 30, seams 22 are formed between adjacent flange areas 52. Referring to FIG. 13, intermediate layer 30 extends continuously around bladder 30 and under the interface between two adjacent panel blanks 50. In this configuration, flange areas 52 from the adjacent panel blanks 50 abut each other. By bonding the flange areas 52 to each other and trimming the flange areas 52, one of seams 22 may be formed. That is, seams 22 are formed in ball 10 by bonding and trimming flange areas 52. In some configurations of ball 10, trimming operations may not be utilized, depending upon the height of flange areas 52.

Figure 14:
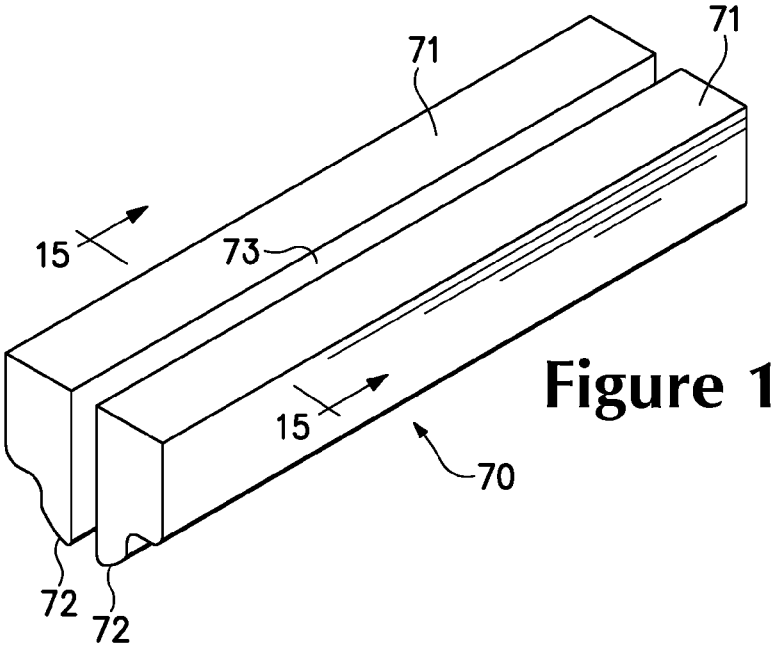
FIG. 14 is a perspective view of a die that may be utilized in forming seams of the sport ball.
Figure 15:
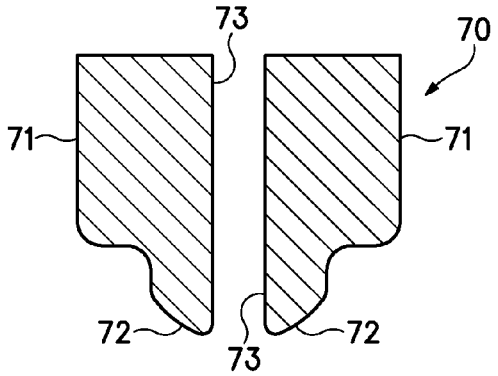
FIG. 15 is a cross-sectional view of the die, as defined by section line 15-15 in FIG. 14.

A die 70 that may be utilized in forming seams 22 is depicted in FIGS. 14 and 15. Die 70 includes two portions 71 that each define a protrusion 72. A length of each portion 71 corresponds with a length of one of the sides of panels 21, which is substantially equal to the length of portions of flange areas 52 that abut each other. Protrusions 72 extend in a downward direction and along the lengths of portions 71. Each portion 71 also defines a facing surface 73 that faces the other portion 71. That is, facing surfaces 73 face each other. Protrusions 72 are positioned adjacent to facing surfaces 73.

Figure 16A:
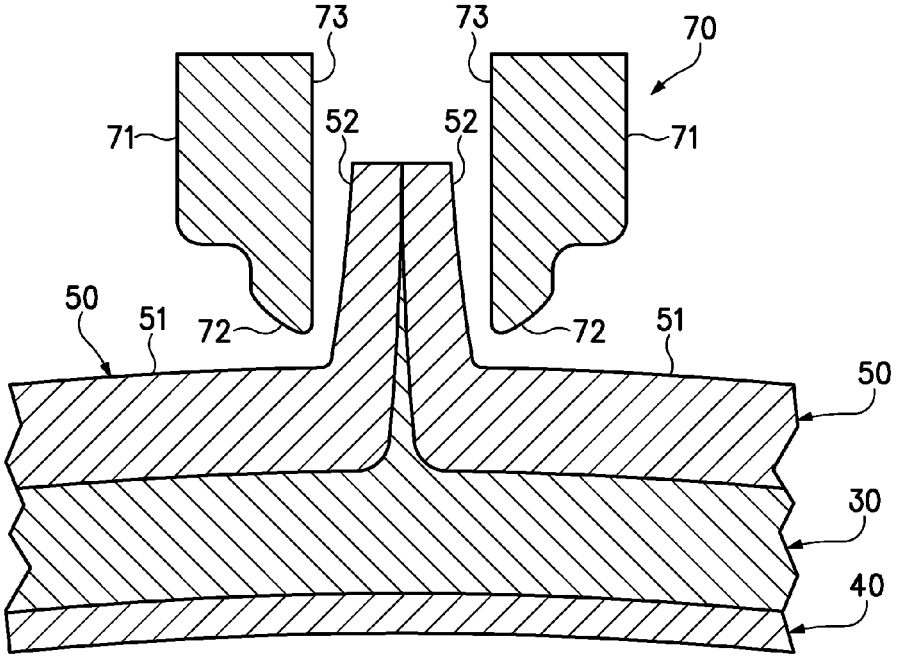
FIGS. 16A-16D are cross-sectional views corresponding with FIG. 15 and depicting a seam formation method for the sport ball.
Figure 16B:
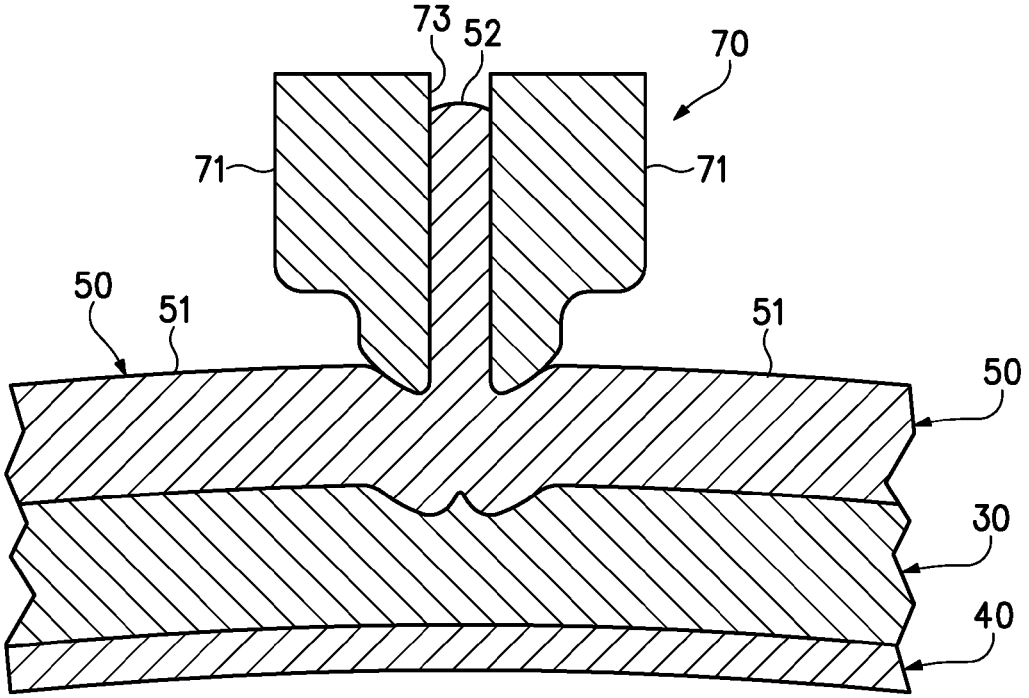

A method of utilizing die 70 to form seams 22 is depicted in FIGS. 16A-16D. Initially, portions 71 are located on opposite sides of the abutting flange areas 52, as depicted in FIG. 16A. Portions 71 then (a) compress the abutting flange areas 52 together between facing surfaces 73, (b) press into ball 10, and (c) heat the abutting flange areas 52, as depicted in FIG. 16B. By heating the abutting flange areas 52, the thermoplastic material forming the abutting flange areas 52 melts or otherwise softens to a degree that facilitates bonding between flange areas 52. Whereas some conventional sport balls utilize stitching or adhesives to join adjacent panels, flange areas 52 are joined through heatbonding.

As utilized herein, the term "heatbonding", or variants thereof, is defined as a securing technique between two elements that involves a melting or softening of at least one of the elements such that the materials of the elements are secured to each other when cooled. In general, heatbonding may involve the melting or softening of the adjacent flange areas 52 (or other portions of panel blanks 50) such that the materials diffuse across a boundary layer between flange areas 52 and are secured together when cooled. Heatbonding may also involve the melting or softening of only one flange area 52 such that the molten material extends into crevices or cavities formed by the other flange area 52, thereby securing the components together when cooled. Accordingly, heatbonding does not generally involve the use of stitching or adhesives. Rather, two elements are directly bonded to each other with heat. In some situations, however, stitching or adhesives may be utilized to supplement the joining of elements through heatbonding.

A variety of processes may be utilized to heatbond the abutting flange areas 52. For example, die 70 may incorporate heating elements that raise the temperature of portions 71, thereby conducting heat to flange areas 52. As another example, die 70 may emit radio frequency energy (RF energy) that heats flange areas 52. More particularly, the radio frequency energy may pass between facing surfaces 73 and through flange areas 52. When irradiated with the radio frequency energy, the temperature of the polymer material forming flange areas 52 increases until melting and softening occurs. Given that flange areas 52 are also compressed between facing surfaces 73, the increased temperature facilitates the formation of a heatbond between flange areas 52.

As noted above, portions 71 press into ball 10 at this stage of forming seams 22. More particularly, protrusions 72 press into ball 10. Although seams 22 may be formed at a position that corresponds with the surfaces of panel areas 51 (i.e., panels 21), protrusions 72 ensure that seam 22 is recessed into the surface of ball 10. That is, indentations are formed in ball 10 at seams 22. An advantage of this configuration is that seams 22 are less likely to experience wear as ball 10 rubs or otherwise abrades against the ground or other surfaces or objects. That is, protrusions ensure that seams 22 are recessed relative to a remainder of panels 21 in order to enhance the overall durability of ball 10.

Figure 16C:
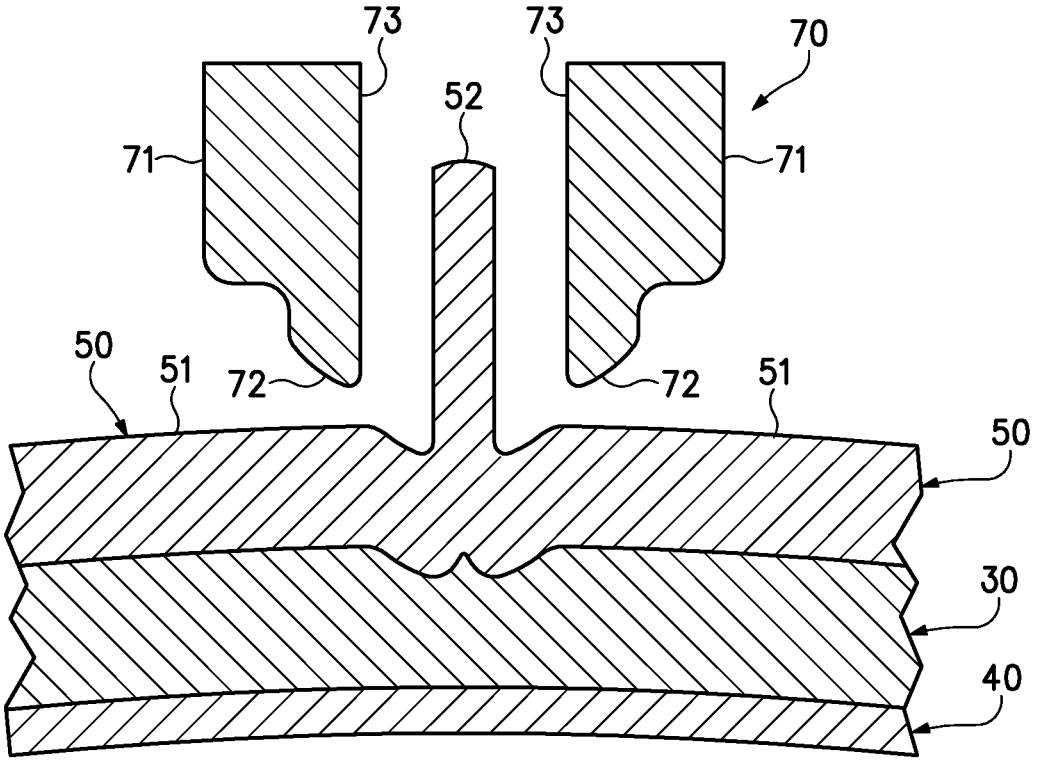
Figure 16D:
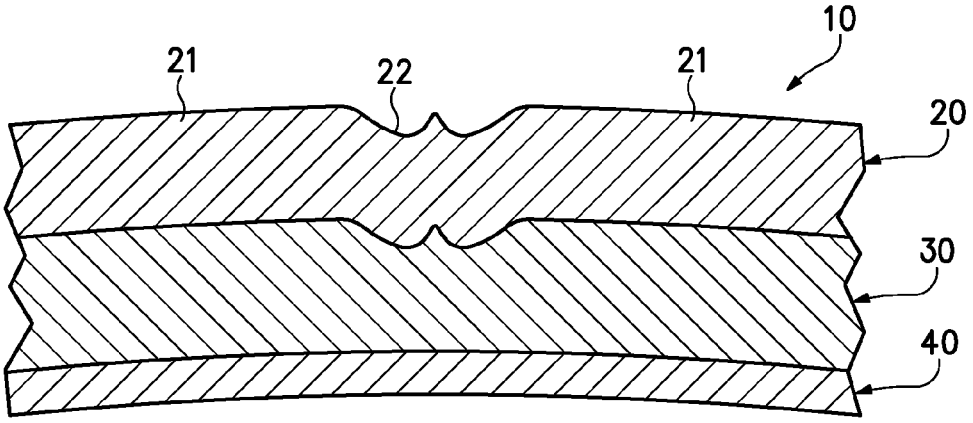
Figure 17:
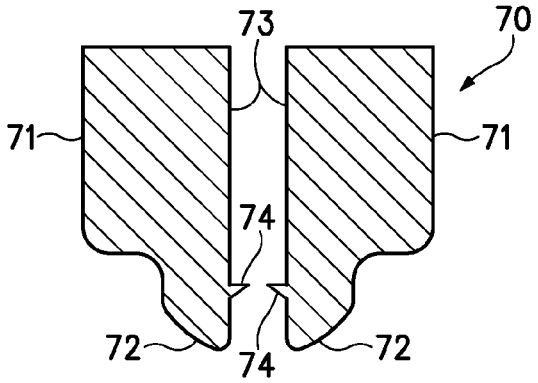
FIG. 17 is a cross-sectional view that corresponds with FIG. 15 and depicts another configuration of the die.

Once flange areas 52 are bonded together, portions 71 may retract from ball 10, as depicted in FIG. 16C. Excess portions of flange areas 52 are then removed to complete the formation of one of panels 21 and seams 22, as depicted in FIG. 16D. A variety of trimming processes may be utilized to remove the excess portions of flange areas 52. As examples, the trimming processes may include the use of a cutting apparatus, a grinding wheel, or an etching process. As another example, die 70 may incorporate cutting edges 74, as depicted in FIG. 17, that trim flange areas 52 during the heatbonding process. That is, cutting edges 74 may be utilized to protrude through flange areas 52 and effectively trim flange areas 52 as portions 71 (a) compress the abutting flange areas 52 together between facing surfaces 73, (b) press into ball 10, and (c) heat the abutting flange areas 52.

The general process of bonding flange areas 52 together and removing excess portions of flange areas 52 may be performed at each interface between panel blanks 50 to effectively form panels 21 and seams 22 (i.e., to form casing 20), thereby substantially completing the manufacture of ball 10.

Additional Construction Methods

Figure 18:
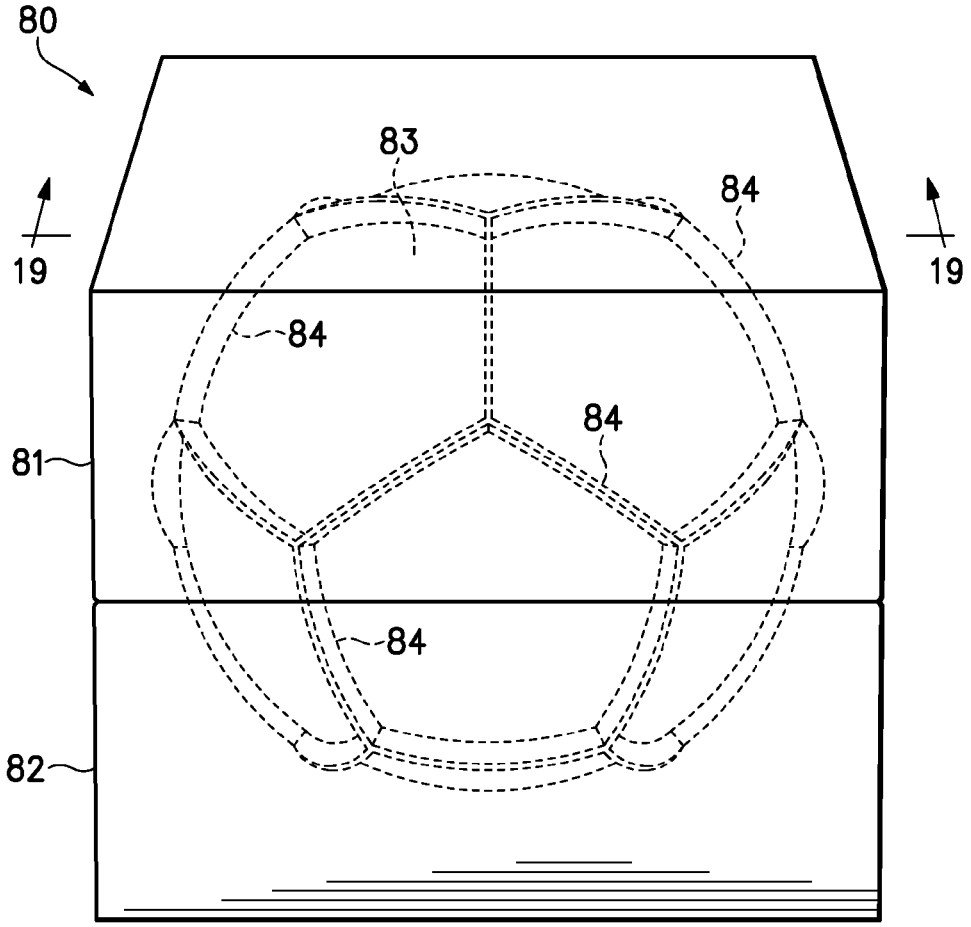
FIG. 18 is a perspective view of a second mold that may be utilized in constructing the sport ball.
Figure 19:
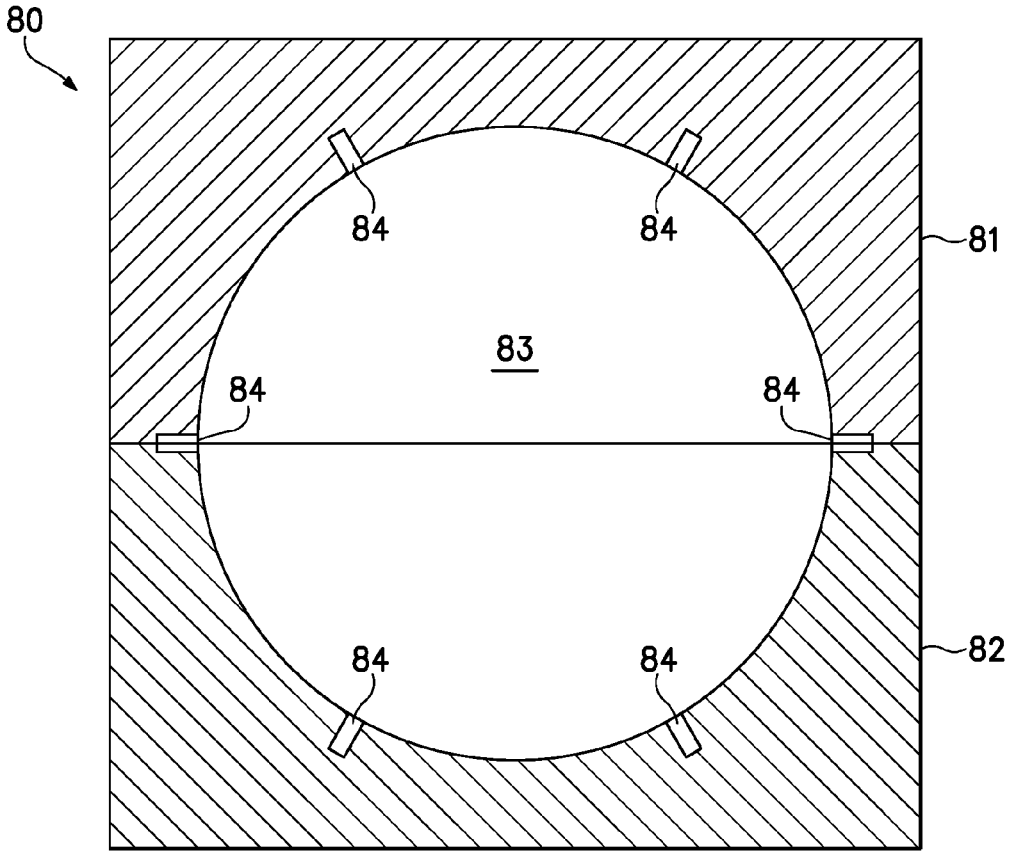
FIG. 19 is a cross-sectional view of the second mold, as defined by section line 19-19 in FIG. 18.

The construction method discussed above provides an example of a suitable method for constructing ball 10. A variety of other methods may also be utilized. Referring to FIGS. 18 and 19 a mold 80 is depicted as having an upper portion 81 and a lower portion 82 that are separable from each other. Portions 81 and 82 cooperatively define a generally spherical interior cavity 83 with a diameter that is substantially equal to a diameter of ball 10. Portions 81 and 82 also define various linear indentations 84 that extend outward from cavity 83 and correspond in location with seams 22 of ball 10.

Figure 20A:
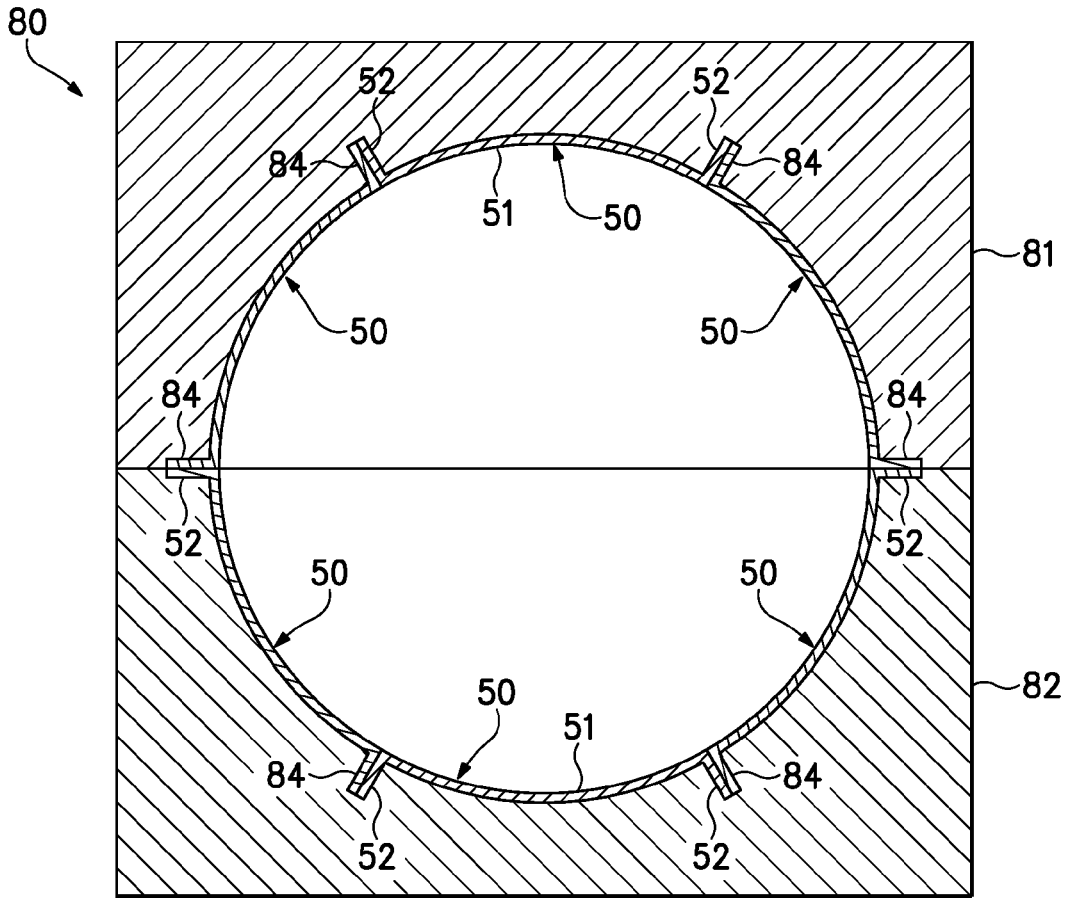
FIGS. 20A-20C are cross-sectional views corresponding with FIG. 19 and depicting a construction method for the sport ball.
Figure 20B:
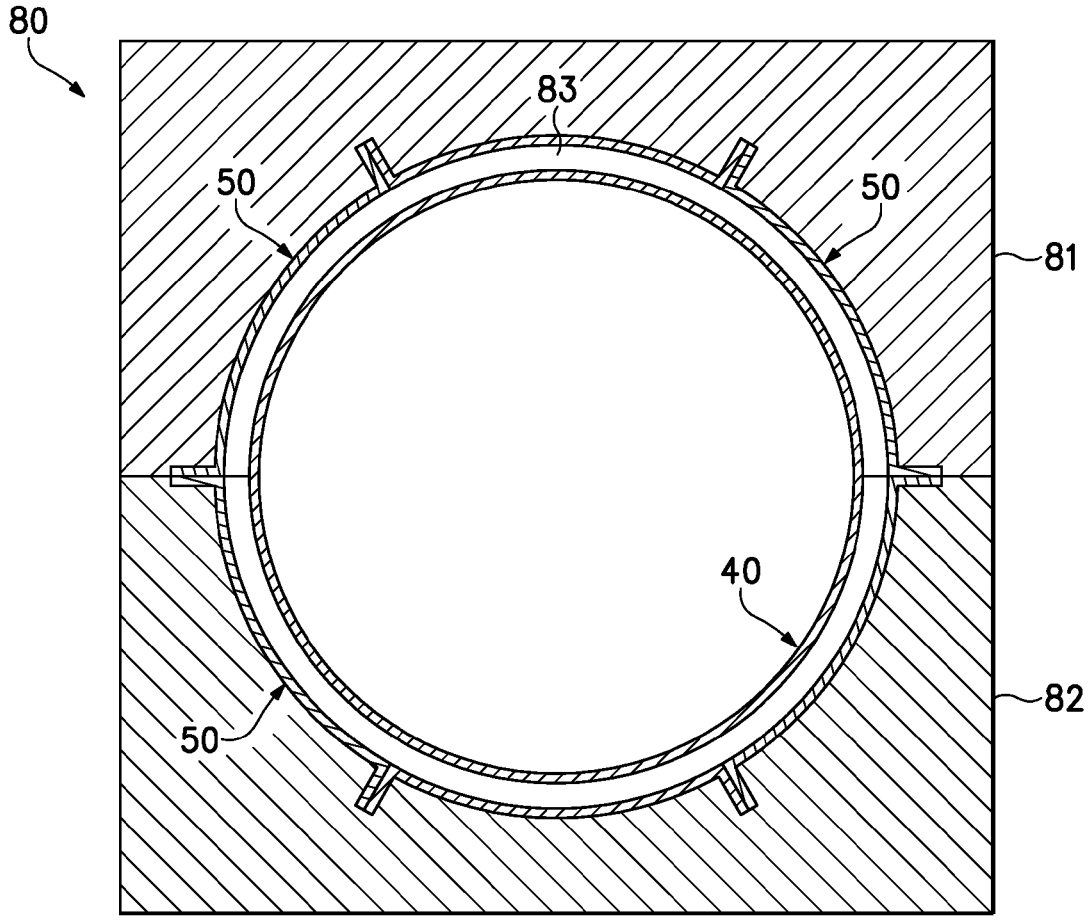
Figure 20C:
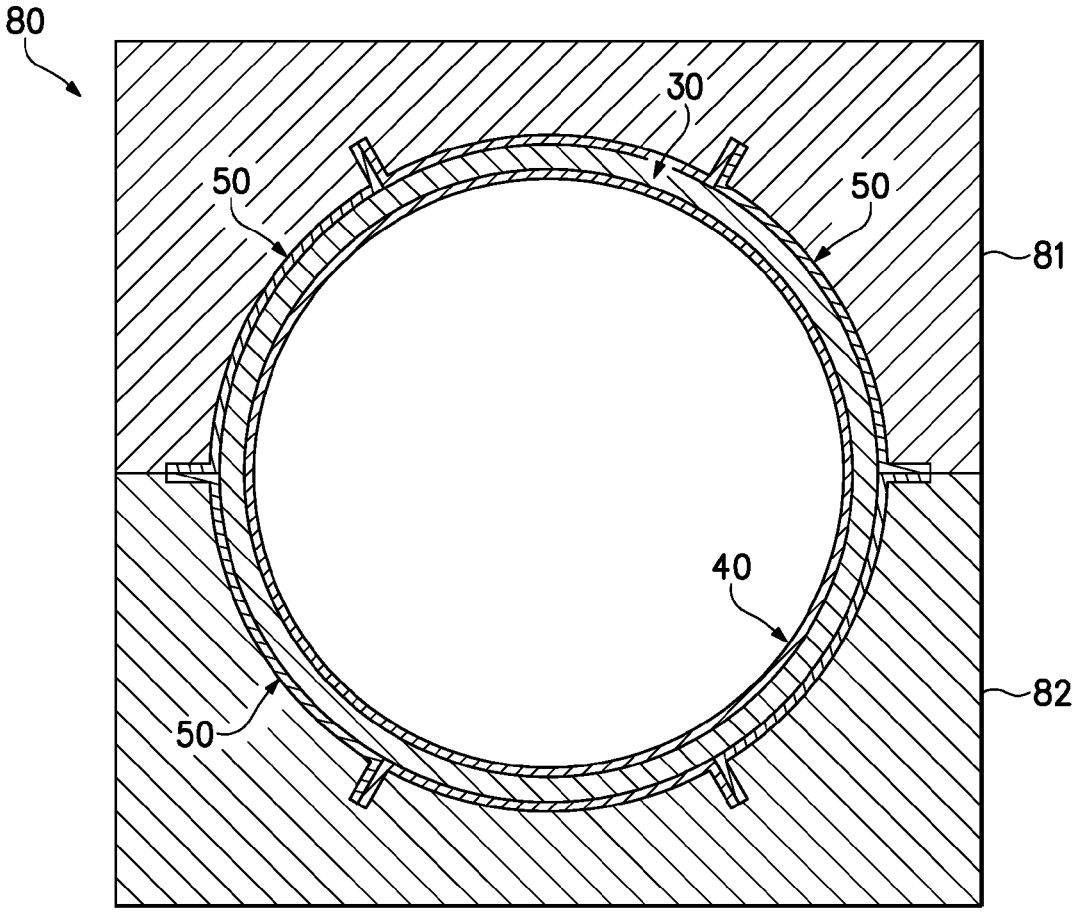

In utilizing mold 80 to construct ball 10, various panel blanks 50 are located within cavity 83 such that (a) panel areas 51 are adjacent to a surface of cavity 83 and (b) flange portions 52 extend into indentations 84, as depicted in FIG. 20A. In addition, bladder 40 is inflated to a generally spherical shape having a diameter that is substantially equal to the diameter of bladder 40 within ball 10. Bladder 40 is then located within cavity 83 and in a position that is spaced from panel blanks 50, as depicted in FIG. 20B. A foam material in an uncured, resinous, or semi-liquid state, which is similar to foam material 66, is then injected into a gap between bladder 40 and blanks 50 to form intermediate layer 30, as depicted in FIG. 20C. Once the foam material has at least partially cured and bonded to bladder 40 and panel blanks 50, mold 80 may be opened by separating portions 81 and 82. The combination of intermediate layer 30, bladder 40, and panel blanks 50 may then be removed and has the general configuration depicted in FIG. 12. The general method discussed above for forming seams 22 may then be utilized to substantially complete the manufacture of ball 10.

Figure 21:
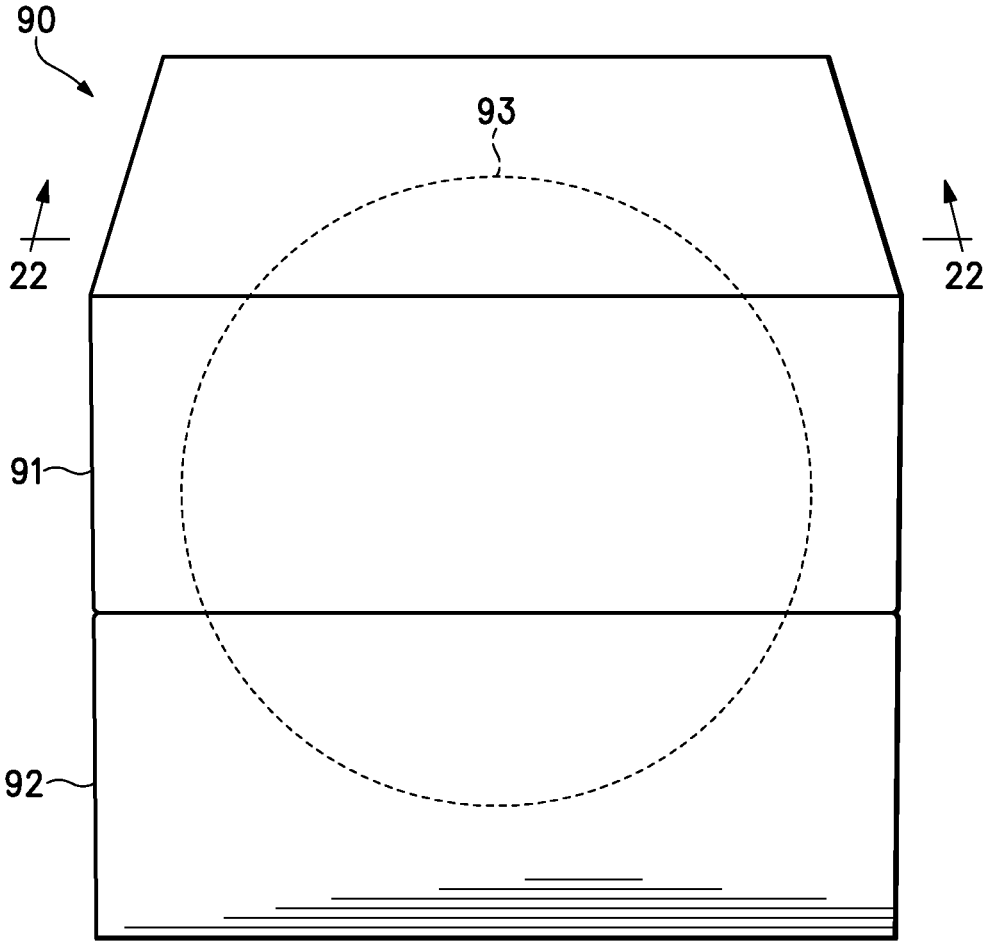
FIG. 21 is a perspective view of a third mold that may be utilized in constructing the sport ball.
Figure 22:
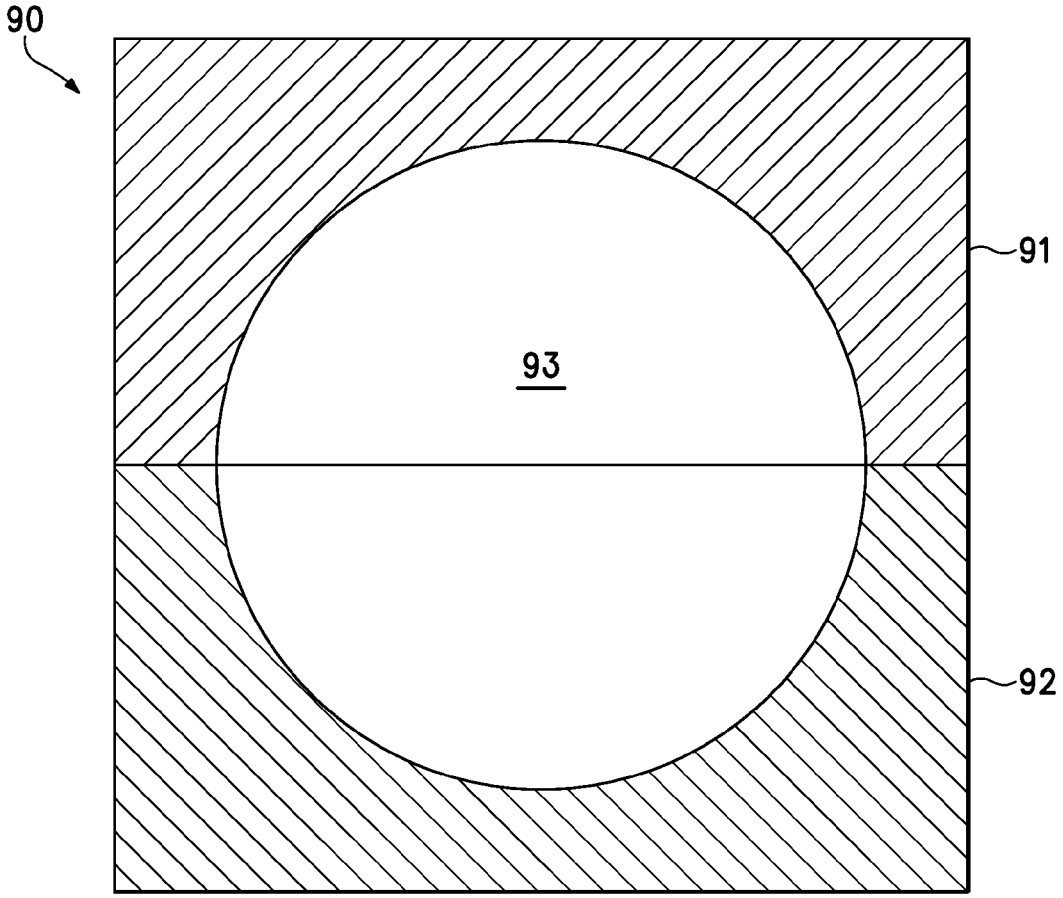
FIG. 22 is a cross-sectional view of the third mold, as defined by section line 22-22 in FIG. 21.

In another construction method, a mold 90 may be utilized to construct ball 10. Referring to FIGS. 21 and 22, mold 90 is depicted as having an upper portion 91 and a lower portion 92 that are separable from each other. Portions 91 and 92 cooperatively define a generally spherical interior cavity 93 with a diameter that is substantially equal to a diameter of intermediate layer 30. In contrast with mold 80, therefore, the diameter of cavity 93 is the diameter of intermediate layer 30. In addition, structures corresponding to indentations 84 are absent from mold 90.

Figure 23A:
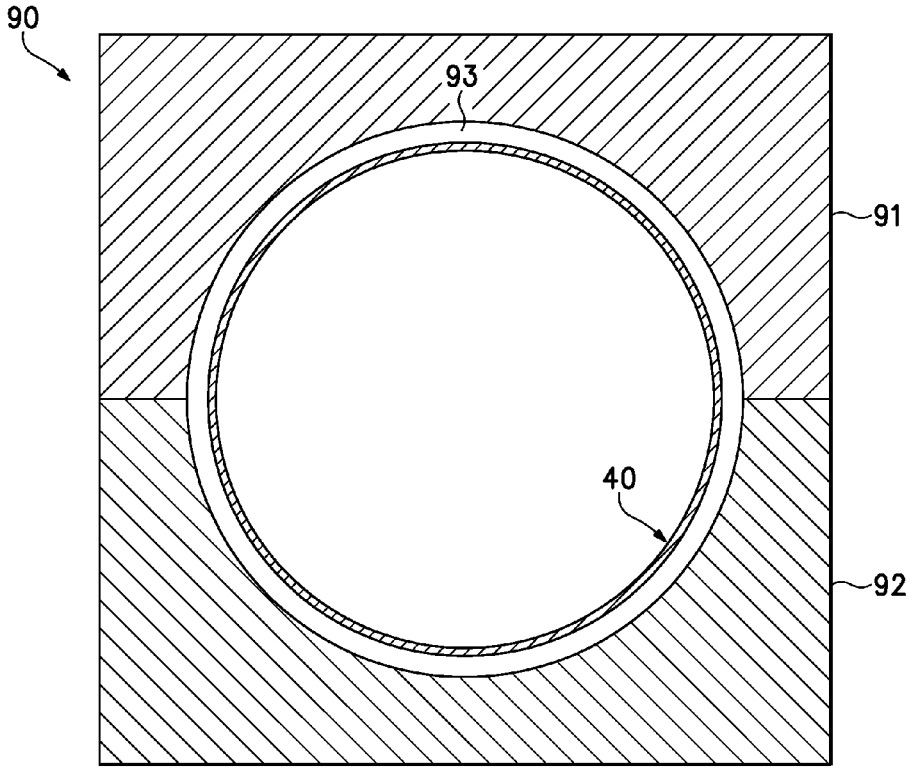
FIGS. 23A and 23B are cross-sectional views corresponding with FIG. 22 and depicting a construction method for the sport ball.
Figure 23B:
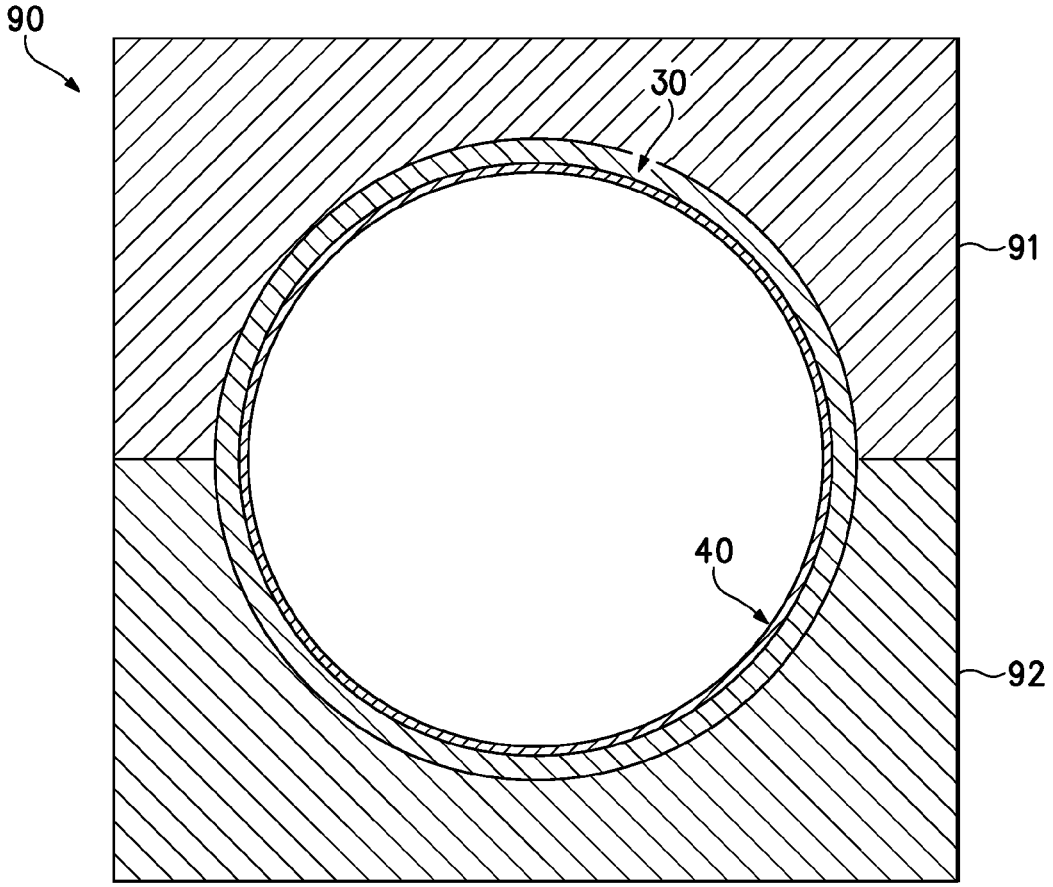

In utilizing mold 90 to construct ball 10, bladder 40 is inflated to a generally spherical shape having a diameter that is substantially equal to the diameter of bladder 40 within ball 10. Bladder 40 is then located within cavity 93 and in a position that is spaced from a surface of cavity 93, as depicted in FIG. 23A. A foam material in an uncured, resinous, or semi-liquid state, which is similar to foam material 66, is then injected into a gap between bladder 40 and the surface of cavity 93 to form intermediate layer 30, as depicted in FIG. 23B. Once the foam material has at least partially cured and bonded to bladder 40, mold 90 may be opened by separating portions 91 and 92. The combination of intermediate layer 30 and bladder 40 may then be removed. Panel blanks 50 are then secured to intermediate layer 30 through heatbonding or adhesive bonding, for example, to impart the general configuration depicted in FIG. 12. The general method discussed above for forming seams 22 may then be utilized to substantially complete the manufacture of ball 10.

CONCLUSION

Based upon the above discussion, intermediate layer 30 of ball 10 is at least partially formed from a foam material and located adjacent to casing 20 and within casing 20. Bladder 40 is located adjacent to intermediate layer 30 and within intermediate layer 30. In this configuration, the foam material of intermediate layer 30 may be bonded to each of casing 20 and bladder 40. In manufacturing ball 10, bladder 40 and a casing element (e.g., one of panels 21 or one of panel blanks 50 are located within a mold, with at least a portion of a surface of the casing element being spaced from a surface of bladder 40. A polymer foam material is then injected into the mold and between bladder 40 and the casing element. In addition, the casing elements may include a thermoplastic polymer material, and the casing elements may be heat-bonded to each other to form seams 22.

The invention is disclosed above and in the accompanying drawings with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sport ball comprising:

a casing that forms at least a portion of an exterior surface of the ball;

an intermediate layer at least partially formed from a foam material, the intermediate layer being located directly adjacent to the casing and within the casing; and a bladder located directly adjacent to the intermediate layer and within the intermediate layer, wherein the foam material of the intermediate layer directly bonds the casing to the bladder;

the bladder including an elastomeric material that substantially prevents air within the bladder from diffusing to the exterior of the ball.

2. The sport ball recited in claim 1, wherein the casing is formed from a plurality of panels, and adjacent panels are bonded to each other to form seams.

3. The sport ball recited in claim 2, wherein the panels include a thermoplastic polymer material at the seams, and stitching and adhesive materials are absent from the seams.

4. The sport ball recited in claim 1, wherein one of the casing and the intermediate layer include a textile material.

5. The sport ball recited in claim 1, wherein the casing includes a textile layer positioned adjacent to the intermediate layer.

6. A sport ball consisting of:

a casing that forms at least a portion of an exterior surface of the ball;

a foam layer located within the casing and bonded directly to the casing; and a bladder located within the foam layer and bonded to the foam layer;

the bladder including an elastomeric material that substantially prevents air within the bladder from diffusing to the exterior of the ball, the elastomeric material being bonded directly to the foam layer;

wherein the casing is formed from a plurality of panels, and adjacent panels are joined to each other to form seams.

7. The sport ball recited in claim 6, wherein the plurality of panels include a thermoplastic polymer material.

8. The sport ball recited in claim 6, wherein stitching and adhesive materials are absent from the seams.

9. The sport ball recited in claim 6, wherein the foam layer is formed from a polymer foam material.

10. A sport ball comprising:

a casing that forms at least a portion of an exterior surface of the ball;

a foam layer located within the casing and in direct contact with the casing; and a bladder located within the foam layer and in direct contact with the foam layer;

the bladder including an elastomeric material that substantially prevents air within the bladder from diffusing to the exterior of the ball;

wherein the foam layer directly bonds the casing to the bladder; and wherein the casing is formed from a plurality of panels, and adjacent panels are joined to each other to form seams.

11. The sport ball recited in claim 10, wherein the foam layer includes a textile element extending through a central area of the foam layer.

12. The sport ball recited in claim 10, wherein the panels include a thermoplastic polymer material at the seams, and wherein stitching and adhesive materials are absent from the seams.

13. The sport ball recited in claim 10, wherein the foam layer is formed from a polymer foam material.

14. The sport ball recited in claim 10, wherein adjacent panels of the casing are joined to each other with heatbonding to form the seams.

15. The sport ball recited in claim 14, wherein the casing includes indentations at the seams, formed by heatbonding radially outwardly extending flanges at edges of the adjacent panels, exerting radially inward pressure, and trimming the flanges.

16. The sport ball recited in claim 2, wherein adjacent panels are bonded to each other with heatbonding.

17. The sport ball recited in claim 16, wherein the casing includes indentations at the seams, formed by heatbonding radially outwardly extending flanges at edges of the adjacent panels, exerting radially inward pressure, and trimming the flanges.

18. The sport ball recited in claim 1, wherein the foam material is formed from a polymer foam material.

19. The sport ball recited in claim 6, wherein adjacent panels are joined to each other with heatbonding.

20. The sport ball recited in claim 19, wherein the casing includes indentations at the seams, formed by heatbonding radially outwardly extending flanges at edges of the adjacent panels, exerting radially inward pressure, and trimming the flanges.

* * * * *